US007071466B2

(12) United States Patent
Glukhoy

(10) Patent No.: US 7,071,466 B2
(45) Date of Patent: Jul. 4, 2006

(54) MASS SPECTROMETRY SYSTEM FOR CONTINUOUS CONTROL OF ENVIRONMENT

(75) Inventor: Yuri Glukhoy, Irwin, PA (US)

(73) Assignee: NGX, Inc., Pittsburgh, PA (US)

( * ) Notice: Subject to any disclaimer, the term of this patent is extended or adjusted under 35 U.S.C. 154(b) by 0 days.

(21) Appl. No.: 10/826,610

(22) Filed: Apr. 19, 2004

(65) Prior Publication Data

US 2005/0230614 A1 Oct. 20, 2005

(51) Int. Cl.
*H01J 49/00* (2006.01)

(52) U.S. Cl. ..... 250/287; 250/294; 250/305; 250/396 R

(58) Field of Classification Search ..... 250/287, 250/294, 305, 396 R
See application file for complete search history.

(56) References Cited

U.S. PATENT DOCUMENTS

| | | | | |
|---|---|---|---|---|
| 5,396,065 | A | 3/1995 | Myerholtz et al. | |
| 5,753,909 | A | 5/1998 | Park et al. | |
| 5,821,534 | A * | 10/1998 | Park | 250/287 |
| 6,107,625 | A | 8/2000 | Park | |
| 6,661,001 | B1 * | 12/2003 | Park | 250/287 |
| 2004/0222372 | A1 * | 11/2004 | McLoughlin et al. | 250/288 |

OTHER PUBLICATIONS

U.S. Appl. No. 10/058,153 filed Jan. 29, 2003 Y. Clukhoy. Edwin Danson, UK. The Economics of Scale: Using Autonomous Underwater Vehicles (AUVs) for Wide-Area Hydrographic Survey and Ocean Data Acquisition.

A. Wilhelmi et al. "Binary Sequences . . . ", Nuclear Instr. & Methods 181, 1970, pp. 36-44.

Reece Rorn, "Industrial Plasma Engineering", vol. 1, Institute of Physics Publishing, Bristol and Philadelphia, 1992, pp. 206-218.

Myerholtz, et al. Sequencing ion Packets for ion time-of-flight mass spectrometry (see U.S. Appl. No. 5,396,065).

Cocg "High duty cycle pseudo-noise modulated TOFMS" (U.S. Appl. No. 6,198,096).

Brock, et al. TOF MS and Ion analysis (U.S. Appl. No. 6,300,626).

Ovoerey et al. "Decunvolution Method and Apparatus" U.S. Appl. 6,524,803).

* cited by examiner

*Primary Examiner*—Nikita Wells
*Assistant Examiner*—Zia R. Hashmi

(74) *Attorney, Agent, or Firm*—Debra M. Parrish

(57) ABSTRACT

A mass spectrometry system for continuous control of environment based on the use of an aerosol TOF MS that provides operation with a high duty cycle of up to 98% and can be realized in the form of a mobile unit having a data acquisition and analysis system with three levels of data correlation on the basis of constant interaction between various actuating mechanisms of the system via a central processing unit. The TOF MS is based on the use of quadrupole lenses with angular gradient of the electrostatic field. As a result, two independently analyzed discrete flows of particles pass through the ion mass separation chamber of the TOF MS without interference with each other. The system can be mounted either on an underwater and ground vehicle, or on an aircraft.

29 Claims, 18 Drawing Sheets

MASS SPECTROMETRY SYSTEM FOR CONTINUOUS CONTROL OF ENVIRONMENT

CROSS REFERENCE TO RELATED APPLICATIONS

The present patent application is related to co-pending U.S. patent application Ser. No. 10/782,122 filed on Feb. 18, 2004 and entitled "IONIZATION DEVICE FOR AEROSOL MASS SPECTROMETER AND METHOD OF IONIZATION" and to co-pending U.S. patent application Ser. No. 10/789,555 filed on Feb. 28, 2004 and entitled "AEROSOL MASS SPECTROMETER FOR OPERATION IN A HIGH-DUTY MODE AND METHOD OF MASS-SPECTROMETRY".

FIELD OF THE INVENTION

The present invention relates to the field of environmental control, in particular to systems of mass spectrometry for control of aqueous and gaseous media, such as the Earth atmosphere and water basins of rivers, lakes, seas, and oceans. More specifically, the invention relates to aerosol mass-spectrometry systems for continuous control of gaseous/liquid media in a continuous mode and with a high duty cycle. The invention also relates to time-of-flight aerosol mass spectrometer systems for operation with a high-duty cycle.

BACKGROUND OF THE INVENTION

An important aspect of environmental control is monitoring the Earth's atmosphere and water basins. Atmospheric aerosols that are contained in the Earth's atmosphere play important roles in climatology and visibility as they absorb and scatter solar radiation. They also may affect human health when they penetrate the human body via the respiratory tracts. Therefore, there have been increased efforts aimed at better characterization of chemical and microphysical properties of aerosol to help elaborate appropriate particulate matter emission standards. Understanding of properties and behavior of atmospheric aerosols is also extremely important for studying the Earth's climate and potential detrimental impact of the aerosols on air quality and human health.

Control of water consists of flow routing along the river network, especially in connection with human activity, surveying of hydrological processes of land-atmospheric interaction such as evapotranspiration and snowmelt, control of sediment and pollutant transport in the streams, etc. It is not less important to control the pollution of water in seas and oceans, especially in the populated coastal areas. The protection of the water supplies is an important goal also for Homeland Defense to prevent pandemic disasters. A future terrorist tactic could include dispersing of the poison containing ampoules can be triggered by remote control. The ampoules could be moved invisibly underwater and put in the bottom of the reservoir.

There exist a number of programs aimed at the development of self-contained environment control systems capable of in-filed control of environment by taking sample of the medium, such as atmospheric air or water of water basins for analysis of the medium content. It is understood that progress in development of such systems depends on a provision of instruments capable of sampling and quickly analyzing the media in large spaces. Such systems should be sufficiently autonomous, mobile, capable of processing a large amount of information, and fast-responsive to abnormal conditions in the controlled medium.

An example of one of the aforementioned programs is development of autonomous underwater vehicles (AUVs) for environmental monitoring in deep water. This program is carried out by a number of companies and universities, such as University of South Florida, Applied Microsystems Ltd., International Submarine Engineering in British Columbia, etc. in the frameworks of the Department of National Defense. In general, the system is mounted on a submarine torpedo or mini-submarine platform that can collect samples of water and provide on-board analysis of the collected samples. The main measurement instrument is a mass spectrometer designed by the University of South Florida and sold to Applied Microsystems Ltd. in British Columbia. The chemical contained in water passes into the mass spectrometer through a thin membrane, which has very low detection limits for dissolved gases and volatile organic compounds. Once inside, the chemical is analyzed and the shape of the discharge plume can be mapped out. The researchers were able to detect the presence of hydrocarbons in the water over the course of the sea trials, which lasted three days and confirmed that chemicals contained, e.g., in the ocean water, can be detected even at very low concentrations. It was the first time that a mass spectrometer was used on an underwater vehicle to analyze a plume of chemical. An advantage of the above-described underwater environment control system is that it utilizes a mass spectrometer which is the most universal medium-control sensor.

However, the environment control system described above, as well any other system of this type known to the applicant of the present patent application, has a number of disadvantages. The main disadvantage is that the mass spectrometers used in these systems are unable to operate with a high-duty cycle as high as 98% and for a majority of known aerosol mass spectrometers the duty cycle does not exceed 40–50%. Simply speaking, the mass spectrometer does not analyze the medium on the half of its operation cycle.

In order to understand the principle of the system of the present invention and its operation, it would be advantageous to briefly describe the existing mass spectrometers and their components.

An instrument which is used for precise analysis of compositions of gases and liquids is an aerosol mass spectrometer. Irrespective of whether the samples are taken from water or air, a mass spectrometer per se operates with dry particles or dried droplets. In the case when samples are taken from water, prior to admission into the vacuum chamber of the mass spectrometer, the samples are pretreated to form a stream of dried descrete particles. The samples are dried even if they are taken from moisture-containing air. Since the present invention relates to environment control systems based on the use of an aerosol mass spectrometer and since the particles or droplets enter the mass spectrometer already in a dry state, the following analysis of the prior art will relate merely to aerosol mass spectrometers without distinction between those taking samples from water or the atmosphere.

A typical aerosol mass spectrometer consists of the following parts: a sample inlet unit with a system for preparation and introduction of a substance to be analyzed into the instrument; a source of particles; an ionization device where the aforementioned particles are charged and formed into an ionized particle flow; a mass analyzer where the charged particles are separated in accordance with an M/Z ratio, focused, and are emitted from the particle source in various directions within a small space angle; a charged-particle receiver or collector where current of charges is measured or converted into electrical signals; and a device for amplification and registration of the output signal. In addition to amount of charged-particles (ion current), the registration unit also receives information about charged-particle mass. Other units included into a mass spectrometer are power supplies, measurement instruments, and a vacuum system. The latter is required for maintaining the interior of the mass spectrometer under high vacuum, e.g. of about $10^{-3}$ to $10^{-7}$ Pa. Operation is normally controlled by a computer, which also stores the acquired data. According to common understanding, ions are defined as charged atoms or molecules of a substance. However, since the aerosol mass spectrometer of the present invention works not only with ions but also with larger particles that may be aggregated from thousands or more than thousands of molecules, where appropriate, instead of the word "ion", we will use the word "particle" which covers both the ions and particles larger than ions. In some instances the word "ion" will be still used in compliance with the generally used terminology. For example, the word "ion" is present in the term: "ionizer" itself or in the word "ionization" that means charging of particles.

The particles contain organic and inorganic compounds and elemental carbon, black, graphite-like material. The particle-phase compounds can be divided into primary and secondary. The primary particulate compounds are of a particle origin, while the secondary compounds results from emission of gases, which then underwent chemical transformation in the atmosphere and condensed on the pre-existing particles. Primary and secondary compounds are emitted by both natural (sea salt from oceans, isoprene from plants) and anthropogenic sources (soot and organics from combustion sources, ammonia from cattle feedlots, etc.). Whether the gas-phase organics are natural or anthropogenic, many can react photochemically in the atmosphere usually by one of three paths: Photons cleave a bond, OH radicals abstract a hydrogen, or ozone reacts with a carbon-carbon double bond. This initial step is often followed by a chain of rapid reactions until a more stable molecule results. Reactions with ozone often produce oxygenated compounds with much lower vapor pressures than the parent compound. That is, the parent compound had a high vapor pressure so was in the gas phase. The daughter compound has a lower vapor pressure so condenses on pre-existing particles forming SOA (Secondary Organic Aerosol). The lower vapor pressure often comes from a compound that became water soluble (polar).

A mass spectrometer is characterized by its resolution capacity, sensitivity, response, and a range of measured masses. The aforementioned response is a minimal time required for registration of mass spectrum without the loss of information within the limits of so-called decade of atomic mass units (1–10, 10–100, etc.). Normally such time is 0.1 to 0.5 sec. for static mass spectrometers and $10^{-3}$ for dynamic (time-of-flight) mass spectrometers.

A substance to be analyzed is introduced into the mass spectrometer with the use of so-called molecular or viscous flow regulators, load ports, etc.

By methods of ionization, ion sources of mass spectrometers can be divided into various categories, which are the following: 1) ionization caused by collisions with electrons; 2) photo-ionization; 3) chemical ionization due to ionic-molecular reactions; 4) field ion emission ionization in a strong electric field; 5) ionization due to collisions with ions; 6) atomic-ionization emission due to collisions with fast atoms; 7) surface ionization; 8) spark discharge in vacuum; 9) desorption of ions under effect of laser radiation, electron beam, or products of decomposition of heavy nuclei; and 10) extraction from plasma.

In addition to ionization, in mass spectrometer an ion source is used also for forming and focusing an ion beam.

More detail general information about types and constructions of ion sources suitable for use in mass spectrometers can be found in "Industrial Plasma Engineering" by Reece Roth, Vol. 1, Institute of Physics Publishing, Bristol and Philadelphia, 1992, pp. 206–218.

By types of analyzers, mass spectrometers can be divided into static and dynamic. Static mass spectrometers are based on the use of electric and magnetic fields which remain, during the flight of charged particles through the chamber, practically unchanged. Depending on the value of the M/Z ratio, the charged particles move along different trajectories. More detailed description of static and dynamic mass spectrometers is given in pending U.S. patent application Ser. No. 10/058,153 filed by Yu. Glukhoy on Jan. 29, 2002.

It should be noted that static mass spectrometers are static installations which are heavy in weight, complicated in construction, and operation with them requires the use of skilled personnel.

In time-of-flight mass spectrometers, charged particles formed in the ionizer are injected into the analyzer via a grid in the form of short pulses of charged-particle current. The analyzer comprises an equipotential space. On its way to the collector, the pulse is decomposed into several sub-pulses of the charged-particle current. Each such sub-pulse consists of charged particles with the same e/m ratios. The aforementioned decomposition occurs because in the initial pulse all charged particles have equal energies, while the speed of flight V and, hence, the time of flight t through the analyzer with the length equal to I are inversely proportional to $m^{1/2}$:

$$T=L(m/2eV)^{1/2}.$$

A series of pulses with different e/m ratios forms a mass spectrum that can be registered, e.g., with the use of an oscilloscope. Resolution capacity of such an instrument is proportional to length L.

An alternative version of the time-of-flight mass spectrometer is a so-called mass-reflectron, which allows an increase in resolution capacity due to the use of an electrostatic mirror. Energies of charged particles collected in each packet are spread over the temperature of the initial gas. This leads to broadening of peaks on the collector. Such broadening is compensated by the electrostatic mirror that prolongs the time of flight for slow charged particles and shortens the time of flight for fast charged particles. With the drift path being the same, the resolution capacity of a mass reflectron is several times the resolution capacity of a conventional time-of-flight mass spectrometer.

In the charged particle source of an RF mass spectrometer, charged particles acquire energy eV and pass through a system of several stages arranged in series. Each stage consists of three spaced parallel grids. An RF voltage is applied to the intermediate grid. With the frequency of the applied RF field and energies eV being constant, only those charged particles can pass through the space between the first and intermediate grids that have a predetermined M/Z ratio. The remaining charged particles are either retarded or acquire only insignificant energies and are repelled from the collection by means of a special decelerating electrode. Thus, only charged particles with the selected M/Z ratio reach the collector. Therefore, in order to reset the mass spectrometer for registration of charged particles with a different mass, it is necessary either to change the initial energy of a flow of charged particles, or frequency of the RF field.

Magnetic resonance mass analyzers operate on a principle that the time required for ions to fly over a circular trajectory will depend on the ion mass. In such mass analyzers, resolution capacity reaches $2.5\times10^4$.

The last group relates to ion-cyclotron resonance mass spectrometers in which electromagnetic energy is consumed by charged particles, when cyclotron frequency of the charged particles coincides with the frequency of the alternating magnetic field in the analyzer. The charged particles move in a homogeneous magnetic field B along a spiral path with so-called cyclotron frequency $\omega_c$=eB/mc, where c is velocity of light. At the end of their trajectory, the charged particles enter the collector. Only those charged particles reach the collector, the cyclotron frequency of which coincides with that of the alternating electric field in the analyzer. It is understood that selection of charged particles is carried out by changing the value of the magnetic field or of the frequency of the electromagnetic field. Ion-cyclotron resonance mass spectrometers ensure the highest resolution capacity. However, mass spectrometers of this type require the use of very high magnetic fields of high homogeneity, e.g., of 10 Tesla or higher. In other words, the system requires the use of super-conductive magnets which are expensive in cost and large in size.

In a quadrupole mass spectrometer, charged particles are spatially redistributed in a transverse electric field with a hyperbolic distribution of the electric potential. This field is generated by a quadrupole capacitor having a D.C. voltage and RF voltage applied between pairs of rods. The flow of charged particles is introduced into a vacuum chamber of the analyzer in the axial direction of the capacitor via an input opening. With the frequency and amplitude of the RF field being the same, only charged particles with a predetermined M/Z ratio will have the amplitude of oscillations in the transverse direction of the analyzer shorter than the distances between the rods. Under the effect of its initial velocity, such charged particles will pass through the analyzer and will be registered and reach the collector, while all other charged particles will be neutralized on the rods and pumped out from the analyzer. Reset of such mass spectrometer to charged particles of another mass will require to change ether the amplitude or the frequency of the RF voltage. Quadrupole mass spectrometers have resolution capacity equal to or higher than $10^3$.

Attempts have been made to improve existing mass spectrometers of the time-of-flight type, e.g., by improving charged-particle storage devices, introducing deflectors for selection of charged-particle for analysis in a mass spectrometer, reorganizing sequencing of charged-particle packets or by extending the time of flight for improving resolution capacity of the mass spectrometers.

For example, U.S. Pat. No. 5,396,065 issued in 1995 to C. Myerholtz, et al. discloses an encoded sequence of charged-particles in packets for use in time-of-flight mass spectrometers, in which the high-mass charged particles of a leading packet will be passed by the low-mass charged particles of a trailing packet. Thus, a high efficiency time-of-flight mass spectrometer is formed. The charged particles of each packet are acted upon to bunch the charged particles of the packet, thereby compensating for initial space and/or velocity distributions of charged particles in the launching of the packet. The times of arrival of the charged particles are determined at the detector to obtain a signal of overlapping spectra corresponding to the overlapping launched packets. A correlation between the overlapping spectra and the encoded launch sequence is employed to derive a single non-overlapped spectrum.

However, such method and apparatus make interpretation of obtained data more complicated and not easily comprehensible. Furthermore, addition electronic circuits are required for control of the charged particle packet sequence.

A disadvantage of the device disclosed in U.S. Pat. No. 5,753,909 consists in that this mass spectrometer is based on the selection of specific charged particles and does not show the entire mass spectrum. For obtaining the entire spectrum, it is necessary to perform step by step scanning, and this requires an additional time.

U.S. Pat. No. 6,107,625 issued in 2000 to M. Park discloses a coaxial multiple reflection time-of-flight mass spectrometer of a time-of-flight type with resolution capacity improved due to a longer time of flight of the charged particles. The apparatus comprises two or more electrostatic reflectors positioned coaxially with respect to one another such that charged particles generated by a charged-particle source can be reflected back and forth between them. The first reflecting device is a charged-particle accelerator which functions as both an accelerating device to provide the initial acceleration to the charged particles and a reflecting device to reflect the charged particles in the subsequent mass analysis. The second reflecting device is a reflectron which functions only to reflect the charged particles in the mass analysis. During the mass analysis, the charged particles are reflected back and forth between the accelerator and reflectron multiple times. Then, at the end of the charged-particle analysis, either of the reflecting devices, preferably the charged-particle accelerator, is rapidly de-energized to allow the charged particles to pass through that reflecting device and into a detector. By reflecting the charged particles back and forth between the accelerator and reflectron several times, a much longer flight path can be achieved in a given size spectrometer than could otherwise be achieved using the time-of-flight mass spectrometers disclosed in the prior art. Consequently, the mass resolving power of the time-of-flight mass spectrometer is substantially increased.

This is a typical system with storage of charged particles, which does not allow a continuous mode of mass analysis since it requires some period for de-energization of one of the reflecting devices. Obviously, the data is difficult to interpret, especially when masses of charged particles are scattered in a wide range so that light charged particles may undergo several reflections while heavy charged particles made only one or two reflections.

The most advanced time-of-flight mass spectrometer (TOF MS) that provides extended time of flight trajectory and hence the time resolution is a quadrupole mass spectrometer developed by Y. Glukhoy and described in aforementioned U.S. patent application Ser. No. 10/058,153. This is the first mass spectrometer known in the art that provides helicoidal trajectories of charged particles by using only electrostatic lens optics.

A mass spectrometer of the aforementioned patent application is based on the use of quadrupole lenses with an angular gradient of the electrostatic field from lens to lens. The device consists of a charged-particle source connected to a charged-particle mass separation chamber that contains a plurality of sequentially arranged electrostatic quadrupole lenses which generate a helical electrostatic field for sending charged particles along helical trajectories in a direct and return stroke. Scattering of positions of points of return is reduced by means of electrostatic mirrors located at the end of the direct stroke, while charged particles of different masses perform their return strokes along helical trajectories different from those of the direct strokes due to the use of a magnetic and/or electrostatic mirrors.

A particle-electron emitting screen is installed on the path of charged particles in the reverse stroke, and positions of collision of the charged particles with the particle-electron emitting screen over time and space are detected with the use of micro-channel plate detectors. Movement of charged particles along the helical trajectory significantly increases the path of charged particles through the charged-particle separation chamber and, hence, improves the resolution capacity of the mass spectrometer.

However, the above-described helical-path quadrupole mass spectrometer, as well as all aforementioned known mass spectrometers of other types, is not very convenient for aerosol applications. This is because in some applications the aerosol analysis should be carried out with sampling and inputting of the aerosol substance into the mass-analyzing unit in a continuous mode. At the same time, all aforementioned apparatuses have a low-duty cycle and are characterized by a limited particle input, i.e., they have a single injection port for inputting particles to be analyzed into the mass spectrometer.

It should be noted that the use of mass spectrometers has come under scrutiny in recent years as a possible solution for a high-speed detection of the aerosol particles in the panorama mode. It can be used for early detection and real-time analysis of aerosol particles in the situation of the large area contamination after the chemical and biological attack or accident, or for general-purpose field, e.g., for monitoring of ozone-consuming organic materials, or the like.

However, the sensitivity of conventional TOF MS is affected by the aforementioned low duty-cycle, meaning only small fraction of charged particles originally in the continuous flow of charged particles is converted into the charged-particle packets and participates in the registration by the charged-particle detectors. Most of the charged particles are discarded from registration during "pulse and wait" time.

It should be recalled that an aerosol TOF MS is supposed to combine several processes which are the following: collection and preparation of samples to a form acceptable for mass spectroscopy; electron impact ionization; bunching of charged particles upon application of an electrical pulse to the gating electrode (usually a charged grid) i.e., conversion of the continuous flow of charged particles into the charged-particle packets; collimation of the flow of charged particles by introducing these charge-particle packets into the charged-particle flight region; traveling of the charged particles in the long drift tube; detecting the charged particles impinging the multi-channel plates; and analyzing the obtained data.

In all known aerosol TOF MS's, a significant amount of sample material is wasted. Usually 98% of the sample is lost during passing through the nozzle, skimmer's collimation, electron impact ionization and the entrance aperture. These losses are unavoidable. But others can be reduced significantly. For example, traveling losses due to collisions with molecules of the residual gas can be reduced by improving the vacuum and reducing the length of the drift tube. This objective was achieved in aforementioned U.S. patent application Ser. No. 10/058,153 due to the use of an extended doubled and helical trajectory of the particles.

It should be noted, that analysis conducted in a conventional aerosol TOF MS requires that the continuous flow of particles be interrupted. Otherwise, it would be impossible to perform selection and tracing of individual particles for which the time-of-flight and, respectively, spectra of masses, have to be determined. However, in conventional aerosol TOF MS, bunching, i.e., in a process that extracts particles from a continuous charged-particle flow, is insufficient and therefore in some cases leads to the loss of very important information and hence to decrease in the sensitivity of the TOF-MS as whole. To increase the signal-to-noise ratio, such conventional systems use expensive amplifiers and logistical systems.

Conventionally, the stream of charged particles is divided into packets of ions that are launched along the propagation path using a traditional "pulse-and-wait" approach. The second packet can't be launched before all charged particles from the first packet reach the charged-particle detector in order to prevent overlapping of signals. Because each packet can contain only a few charged particles of the species of the materials, the experiment has to be repeated many times. So, it is impossible to reach in the condition of the flight the quality of the measurement that is sufficient to identify the aerosol compound using a conventional TOF MS. In other words, conventional TOF MS's have a limited low duty cycle, and the authors are not aware of any known means that can increase the duty cycle above 60%.

For measurement of masses of particles, the data obtained in an aerosol TOF MS must be analyzed. Heretofore, different methods have been used for reconstruction of the particle distribution spectra in acquisition period of the cycle. Such methods are described e.g., by the following authors: 1) G. Wilhelmi, et al. in "Binary Sequences and Error Analysis for Pseudo-Statistical Neutron Modulators with Different Duty Cycles," Nuclear Inst. and Methods, 81 (1970), pp. 36–44; 2) Myerholtz, et al. "Sequencing ion packets for ion time-of-flight mass spectrometry" (see aforementioned U.S. Pat. No. 5,396,065 described earlier in the description of the prior art); 3) Cocg "High duty cycle pseudo-noise modulated time-of-flight mass spectrometry" (U.S. Pat. No. 6,198,096, issued Mar. 6, 2001; 4) Brock, et al. "Time-of-flight mass spectrometer and ion analysis" (U.S. Pat. No. 6,300,626, issued Oct. 9, 2001); 5) Overney, et al. "Deconvolution method and apparatus for analyzing compounds" (U.S. Pat. No. 6,524,803, issued Feb. 25, 2003), etc.

The above methods utilize special properties of the pulsing sequence, e.g., a pseudo-random binary sequence (PRBS) or Hadamard Transform. However, they cannot reach a high duty-cycle because their TOF MS's annihilate a part of the flow of charged particles by a gating grid [see references 3) and 4)] or deflecting mesh [see reference 5)] during binary modulation that they converted. This is because at least a half of the charged-particle flow must be discarded to allow the other half to be counted. The flow of charged particles sputters and contaminates the modulation grids or meshes and creates secondary electron-, ion-, or photon-emission leading to deterioration of the grids. Furthermore, foreign species introduced in the drift space because of contamination and sputtering destruct the detectors and distort the information. The low sensitive flat deflection system, which is used in the in the A.Brock et al TOF-MS for the Hadamard's transform, contains a high density array of the wires with alternating potential that leads to breakdown.

So the conventional TOF-MS's with the pseudo-random binary methods of bunching of the ion packets can not provide high duty cycle, have low sensitivity and reliability, and cannot serve properly as monitoring devices for field applications because of the incorrect choice and design of the ion optics and the irrational bunching strategy.

The disadvantages of the known aerosol TOF MS's systems make them unsuitable for use in monitoring the condition of the environment in a continuous real-time mode of operation with high-duty cycle. In other words, the known TOF MS's systems are unsuitable for use under extreme or critical conditions such a biological attack or an environmental disaster, e.g., a hazardous leakage or contamination of water reservoirs in populated areas.

SUMMARY OF THE INVENTION

It is an object of the present invention to provide a system for continuous real-time control of environment on the a basis of an aerosol time-of-flight mass (TOF MS) spectrometer suitable for continuous operation in a high-duty mode. Still another object is to provide the aforementioned system that has a compact construction and can be installed on a vehicle moveable through the controlled environment. Still another object is to provide the aforementioned system with self-adjustment means that can tune the sample preparation unit and the mass spectrometer to the most optimal conditions of operation, depending on the type of detected particles. A further object is to provide the aforementioned system which is universal and can operate in a mode of interaction with the on-board data library or in a mode of interaction with a remotely located control station.

A system of the present invention for control of environment consists of a vehicle, that can be underwater, ground-type, or aerial vehicle and a real time high-duty cycle mass aerosol time-of-flight mass spectrometer (TOF MS). The latter is based on the use of quadrupole lenses with angular gradient of the electrostatic field. On the entrance side, the TOF MS contains an ion-optic system that is used for focusing, aligning, and time-modulating the ionized flow of droplets and a deflector modulator that provides alternating deflections of the flow of particles between two positions for aligning the flow with two inlet openings into the TOF MS. As a result, two independently analyzed flows of particles pass through the ion mass separation chamber of the TOF MS without interference with each other. The ion mass separation chamber contains a plurality of sequentially arranged coaxial electrostatic quadrupole lenses which generate a helical electrostatic field for sending ions along helical trajectories in a direct and return stroke. Scattering of positions of points of return is reduced by means of electrostatic mirrors located at the end of the direct stroke. On their return paths, depending on their masses, the droplets of the same ion beam current pulses will hit the respective micro-channel plate detectors located on the entrance side in different points and at different times. The ions incident on the micro-channel plate detector knock out secondary electrons from the surface of the detector, and the moment of the collision will be registered as a pulse on the output of the respective micro-channel plate detector. The time of the collision and the magnitude of the pulse will contain information about the M/Z ratio for the droplets being registered. Accurate detection of collision time is possible due to extremely high-resolution capacity of these devices. Multiplication of a single flow of particles into a plurality of independently and concurrently analyzed flows increases efficiency of the TOF MS and makes it possible to use it in continuous and high-duty applications. The efficiency of the duty cycle can be as high as 98%. The system is provided with a data processing unit that processes the data obtained from the measuring part of the system, stores the obtained data, compares the data with those stored in the on-board data library, and transmits the obtained and analyzed data to a central processing unit that can be located either on a vehicle or partially in a remote station. All these features make the mass spectrometer suitable for application in the environment control system of the invention.

DETAILED DESCRIPTION OF THE INVENTION

Figure 1A:
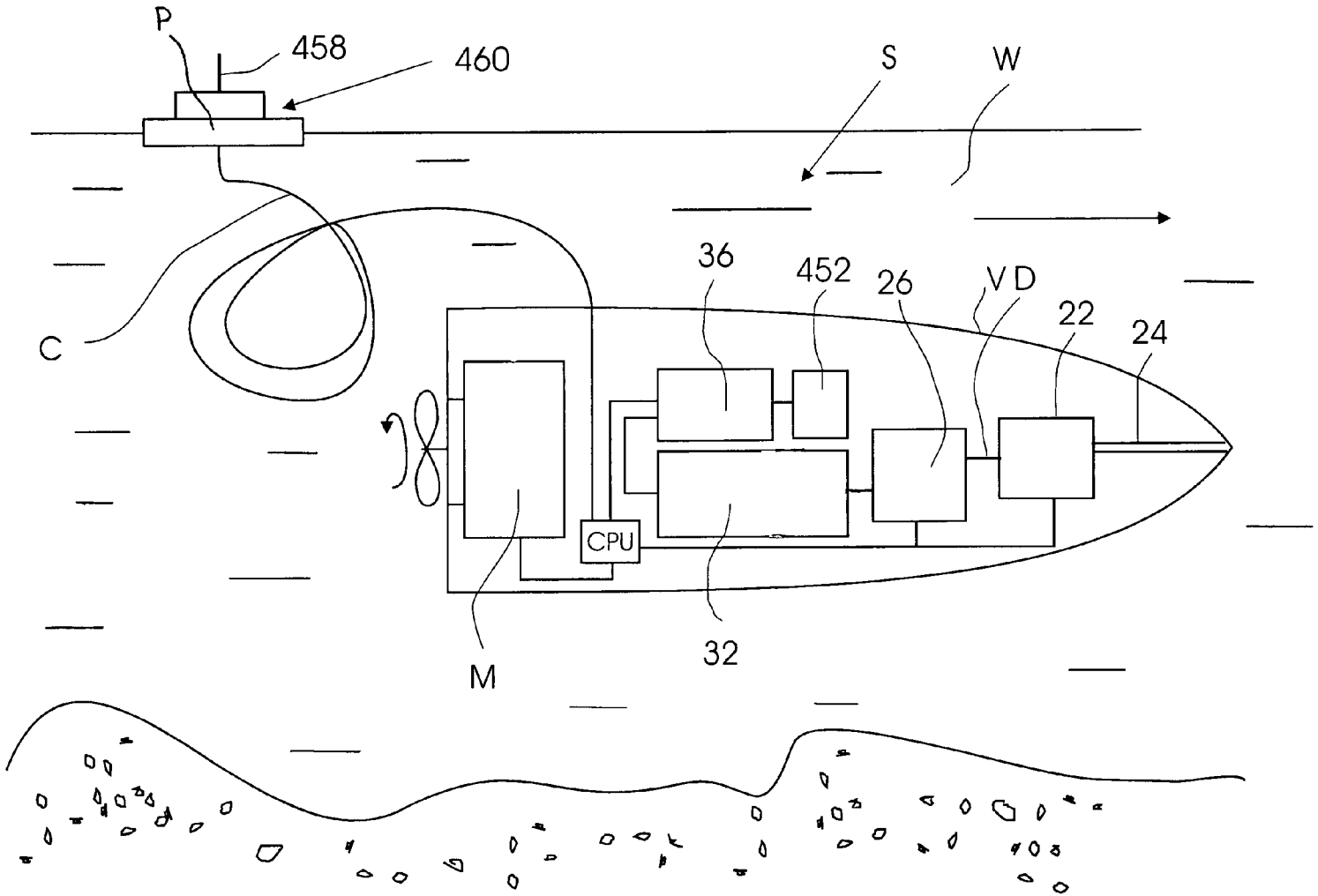
FIG. 1A is a schematic general view of the main components of the system of the invention.

FIG. 1A is a schematic general view of main components of the system of the invention. The system, which in general is designated by symbol S, consists of a vehicle V, which in the illustrated embodiment is shown as an underwater vehicle, e.g., a submarine platform that contains in a hermetically sealed part thereof the following units arranged in sequence starting from the front end of the vehicle: a sample preparation unit: vehicle V, which in the illustrated embodiment is shown as an underwater vehicle, e.g., a submarine platform that contains in ia hermetically sealed part thereof the following units arranged in sequence starting from the front end of the vehicle: a sample preparation unit: vehicle V, which in the illustrated embodiment is shown as an underwater vehicle, e.g., a torpedo platform that contains in a hermetically sealed part thereof the following units arranged in sequence starting from the front end of the vehicle: a sample preparation unit: 1) a sampling device 22 which produces trains of uniformly-sized and uniformly-spaced droplets D of a liquid that may contain a sought substance; 2) an ionization device 26 which is connected to the sampling device 22 for receiving the aforementioned train of the uniformly-sized and uniformly-spaced droplets D and for ionization of the droplets during transportation through this device; 3) an aerosol TOF MS unit 32 that receives the ionized and diverged train of droplets D, focuses this train of droplets, and distributes the droplets over their mass/charge ratio; and 4) data acquisition and analysis unit 36 that acquires, accumulates the data from the aerosol TOF MS unit 32 in a real-time mode, and analyses concentration and changes in concentration of a target substance in the investigated medium. Reference numeral 452 designates a data library that comprises a data bank with data used for comparison with the results of the analysis. All units of the data analyzing system are connected to a central processing unit CPU. A prime mover M of the vehicle is installed at the end opposite to the sample preparation unit 22.

The system S also includes a platform P floating on then surface of water W and contains a navigation and data exchange unit 460. The platform P supports a communication cable C for connection with the CPU. Now, the aforementioned main units will be considered separately in more detail.

Sampling Unit

In the aerosol TOF MS of the invention, the principle of sampling is based on a device similar to the one disclosed in U.S. Pat. No. 5,345,079 issued in 1994 to J. French, et al. In accordance with the above patent, a liquid sample to be analyzed is fed to a micro pump. The pump directs the solution, as a stream of uniformly sized and spaced droplets, into a laminar stream of hot carrier gas. The carrier gas evaporates the solvents (e.g. water) in the droplets to form a stream of dried particles. The stream of particles can be then vaporized. Similar to the sampling unit of our invention, the sampling unit of U.S. Pat. No. 5,345,079 is intended for sending the stream of uniformly sized and spaced droplets to an ionizer and then to a mass spectrometer, or the vapor can be analyzed by optical spectroscopy.

Figure 2:
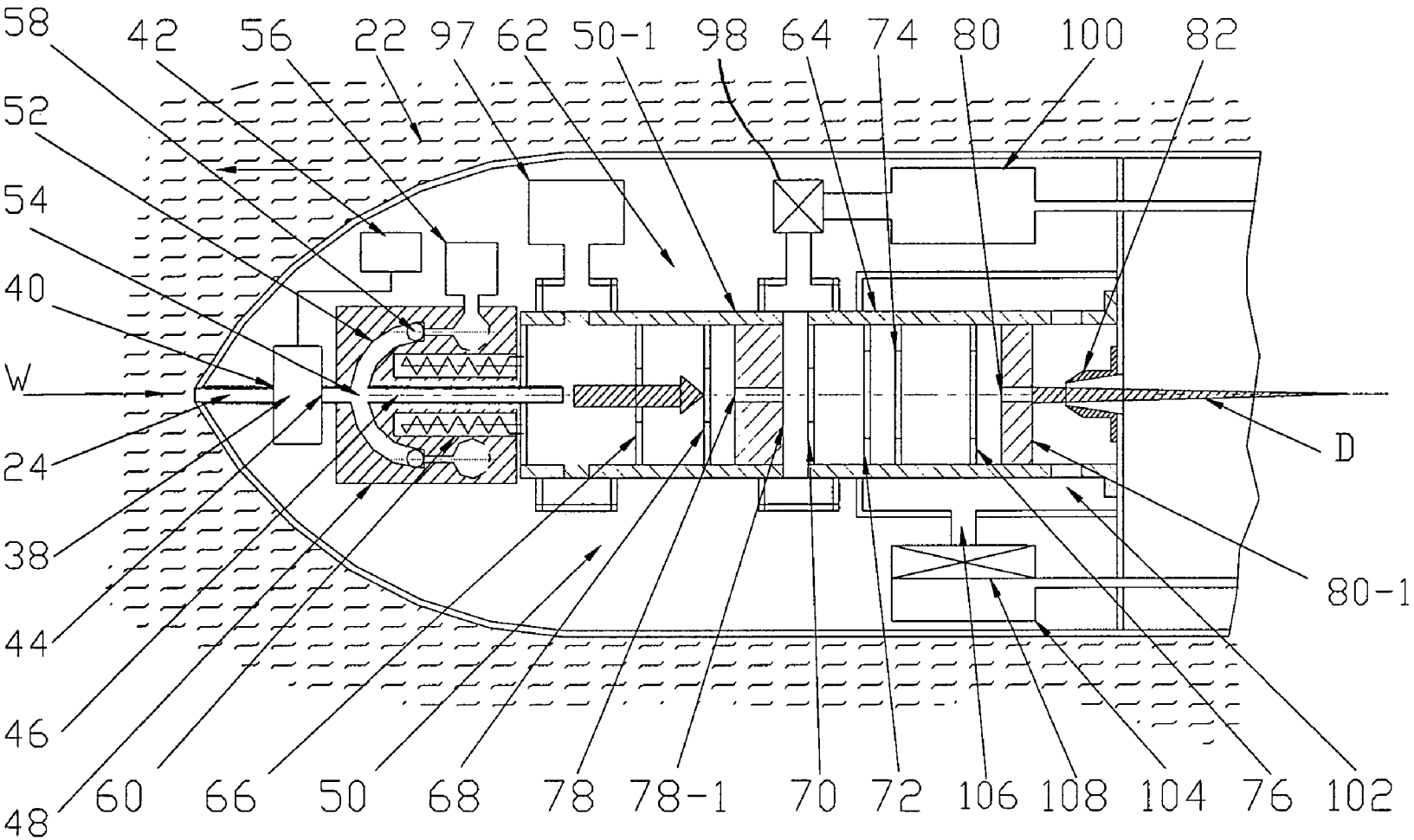
FIG. 2 is a sectional view of the sampling unit used for sampling and preparing droplets for inputting into the ionization device of the present invention.

The sampling unit 22 of the aerosol TOF MS system of the present invention is shown in FIG. 2. This unit produces trains of uniformly-sized droplets D and contains a micro pump 38, which has an inlet port 40 connected to the sampling unit 22 via an interface 24, e.g., in the form of a pipe submerged into the investigated media such as sea water W. The micro pump 38 is connected to a signal source 42 for supplying the pump 38 with an electrical signal required for controlling the droplet repetition rate or frequency. The micro pump 38 has an outlet port 44 connected to a narrow tube 46 for ejecting droplets D at a velocity of between 2 and 4 meters per second. The aforementioned tube 46 is located over much of its length in a metal mixer block 48 at the entrance to an aerodynamic lens system 50 which will be described later.

The mixer block 48 (FIG. 2) contains an annular gas passage 52, which is concentric and coaxial with the tube 46. The passage 52 joins the tube 46, and the place of joining, which in FIG. 2 is designated by reference numeral 54, is carefully shaped and smoothed to avoid turbulence. A carrier gas such as argon is supplied from a gas source 56 into the passage 52. The passage has a settling screen 58 that is intended for eliminating a local turbulence in the flow of carrier gas and maintains the flow under laminar conditions.

The mixer block 48 is provided with heater rods 60 that maintain the block 48 heated to a substantial temperature. The heater rods 60 are located in the metal annulus of the block 48 between the passage 52 and the tube 46. The heater rods 60 heat the flow that passes through the tube 46 for evaporation of water from the droplets D leaving a stream of dried micro particles that are injected together with argon through the aforementioned aerodynamic lens system 50 as a supersonic flow.

The sampling unit of the type disclosed in U.S. Pat. No. 5,345,079 introduces the flow of ionized particles directly to the vacuum chamber of a mass spectrometer without the use of any intermediate preparatory device. Therefore, the sampling unit of this type has a very short service life. This is because the inlet orifices for the introduction of the flow of droplets D to the TOF MS are quickly contaminated and clogged, so that the process has to be stopped and the orifice has to be cleaned or replaced. This drawback makes the aforementioned combination unacceptable for operation in a continuous mode for which the system S (FIG. 1A) of the present invention is intended. Means that are used in the system of the invention for eliminating the above drawback will be described later.

Figure 1B:
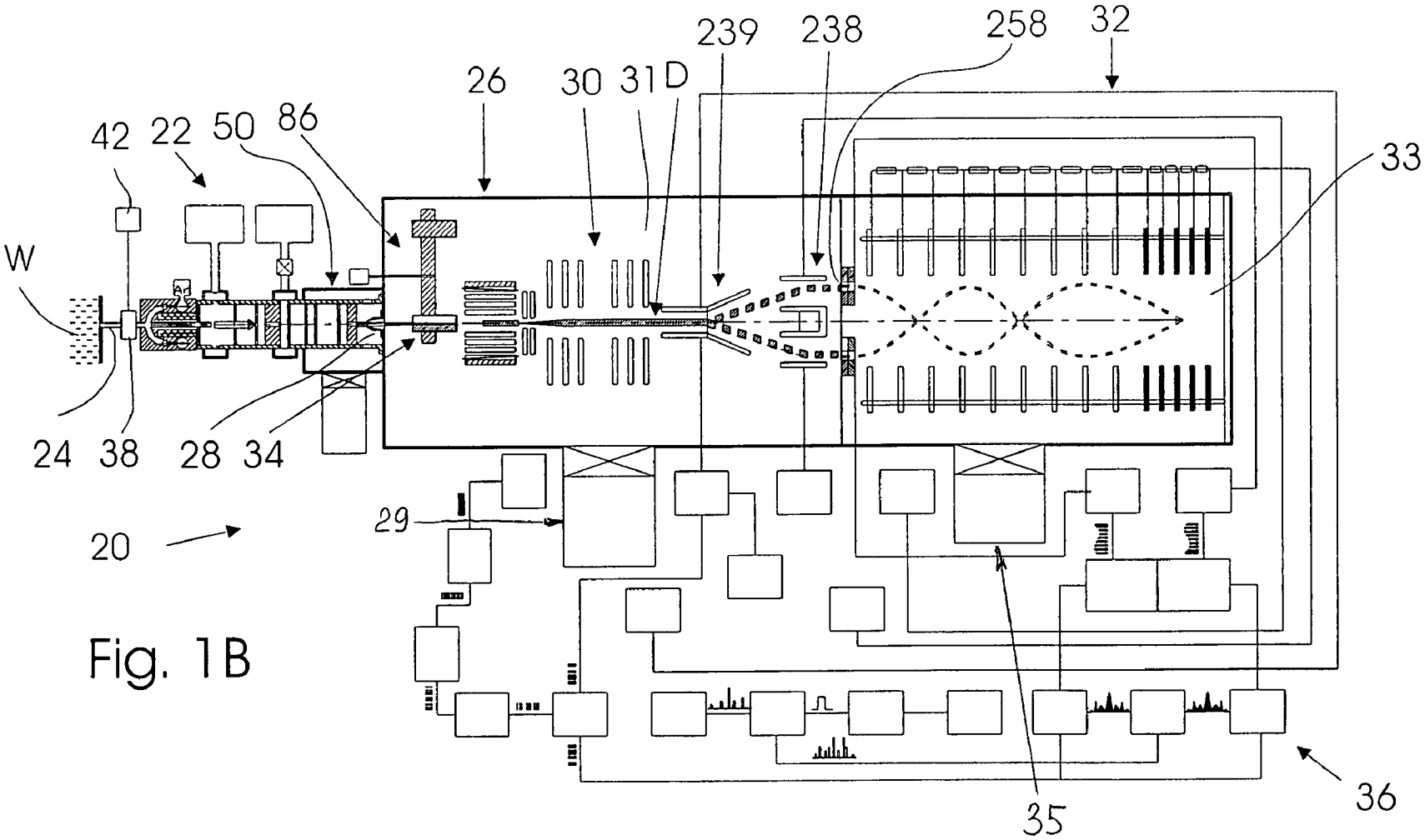
FIG. 1B is a more detailed view of a subsystem that includes main functional units of the system of FIG. 1A.

The aerosol TOF MS 32 of the system S of present invention is schematically shown in FIGS. 1B and 2. The aerosol TOF MS 32 is provided with an aerodynamic lens system 50 located in the sampling unit 22 and the ionizer 26.

The aerodynamic lens system 50 is intended for improving control of particle sizing and for scanning the particle size. The structure and principle of operation of aerodynamic lenses suitable for the purposes of the present invention is disclosed in U.S. Pat. No. 6,259,101 issued in 2001 to A. Wexler, et al., U.S. Pat. No. 5,565,677 issued in 1996 to A. Wexler, et al., and in article by P. Middha, et al. "Particle Focusing Characteristics of Sonic Jets". Aerosol Sci. Technol. 37:907–915, 2003.

More specifically, the aerodynamic lens system 50 (FIG. 2) consists of two vacuum stages and a number of aerodynamic lenses in each stage. Each aerodynamic lens comprises an annular body with an opening of a predetermined diameter with gradual decrease in the diameter of the lens in propagation direction of the stream.

The aerodynamic lenses accomplish the task of particle beam formation, which occurs under a reduced pressure. Two stages 62 and 64 of the aerodynamic lens system 50 (FIG. 2) are arranged into a single column 50-1 (FIG. 2) and comprise a series of aerodynamic lenses 66, 68 in the first stage 62 and a series of aerodynamic lenses 70, 72, 74, and 76 in the second stage 64. The first stage 62 and the second stage 64 communicate through an orifice 78. The second stage 64 has on its outlet two sequentially arranged orifices, 80 and 82 which are coaxial to a diaphragm 84 (FIGS. 3A and 3B which are described later) installed on the periphery of a rotary diaphragm-replacement system 86. In fact, the rotary diaphragm-replacement system 86 belongs to another unit, i.e., the ionization device 26 which will be described in detail later. The orifice 82 functions as a final skimmer at the outlet from the second stage 64.

The above-described aerodynamic lens system 50 is quite effective in moving large particles to the centerline of the orifices 78, 80, 82, and 84. Beam divergence of small particles can be reduced by using a differentially pumped inlet. The deposition losses for medium size particles can be reduced using a transitional diaphragm. For this, as has been describe above, the lenses are arranged with a decrease of the diameters of their openings in the flow propagation direction.

Although specific number of aerodynamic lenses was shown and described with reference to FIGS. 1B and 2, any number of the stages and any number of lenses in each stage section can be used. While the diameters of the lens openings are reduced in the down flow direction, distances between these lenses are sequentially increased in the same directions.

The first stage 62 is preferably at atmospheric pressure, but if necessary to mach the pressure of the stage 62 with the pressure in the flow emitted through the tube 46, the apparatus is provided with a preliminary vacuum pump 97 (FIG. 2) which is connected to the first stage 62 and may adjust the pressure in this stage. Because of the provision of the lenses 66 and 68, the atmospheric pressure aerosol is formed into a beam of droplets D where all of the droplets D are aligned. The beam then passes through an orifice 78 in the capillary 78-1 at the downstream end of the first stage 62. The diameter of the orifice 78 is less than the diameter of the opening in the aerodynamic lens 68.

A vacuum pump 100 is in communication with a space between the end of the first stage 62 and the beginning of the second stage 64, or between the orifice 78 and the aerodynamic lens 70 via a CPU-controlled valve 98. The pump functions to reduce the pressure to an intermediate pressure, such as 50 Torr in the second stage 64. In addition, much of the gas in the aerosol flow is removed by the pump 100 before the path enters the second stage 64.

After the particle beam passes through the second set of the aerodynamic lenses 70, 72, 74, and 76 of the second stage 64 and then through the orifice 80 of the capillary 80-1, the particle beam enters evacuated region 102. The region 102 is evacuated by a pump 104 through pump connection 106 which functions to reduce the pressure in region 102 to, for example, 0.01 Torr and also to remove carrier gas remaining in the particle beam. Thus, the column 50-1 forms a particle beam wherein the atmospheric pressure aerosol is brought through aerodynamic lenses and through orifices into a region of intermediate pressure. Much of the gas is removed through the first pump 100 and the remaining particles are passed through another set of aerodynamic lenses and another orifice 80 before entering the evacuated region 102.

The second stage 64 may be provided with a pressure gauge 108 to confirm that the second stage 64 is under the proper intermediate pressure.

Ionization Device

Figure 3A:
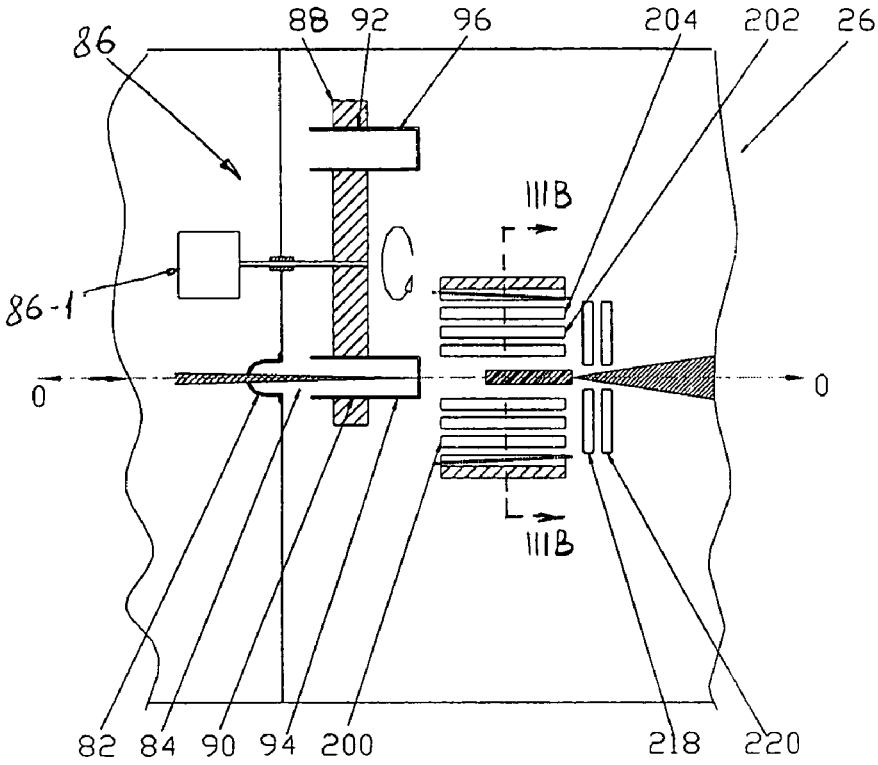
FIG. 3A is a longitudinal sectional view that illustrates arrangement of units in the ionization device of the system of the present invention.
Figure 3B:
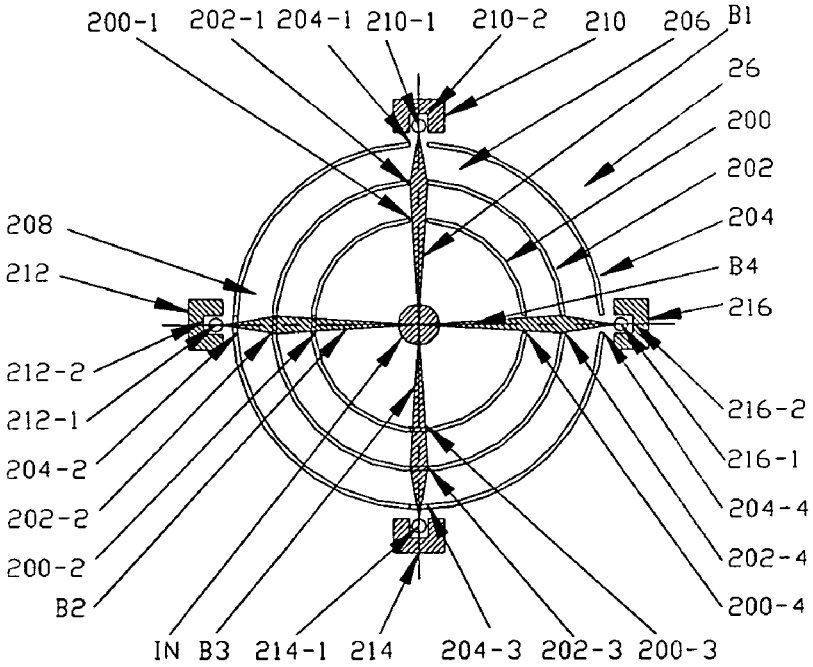
FIG. 3B is a cross-sectional view along the line IIIB—IIIB of FIG. 3A.
Figure 4:
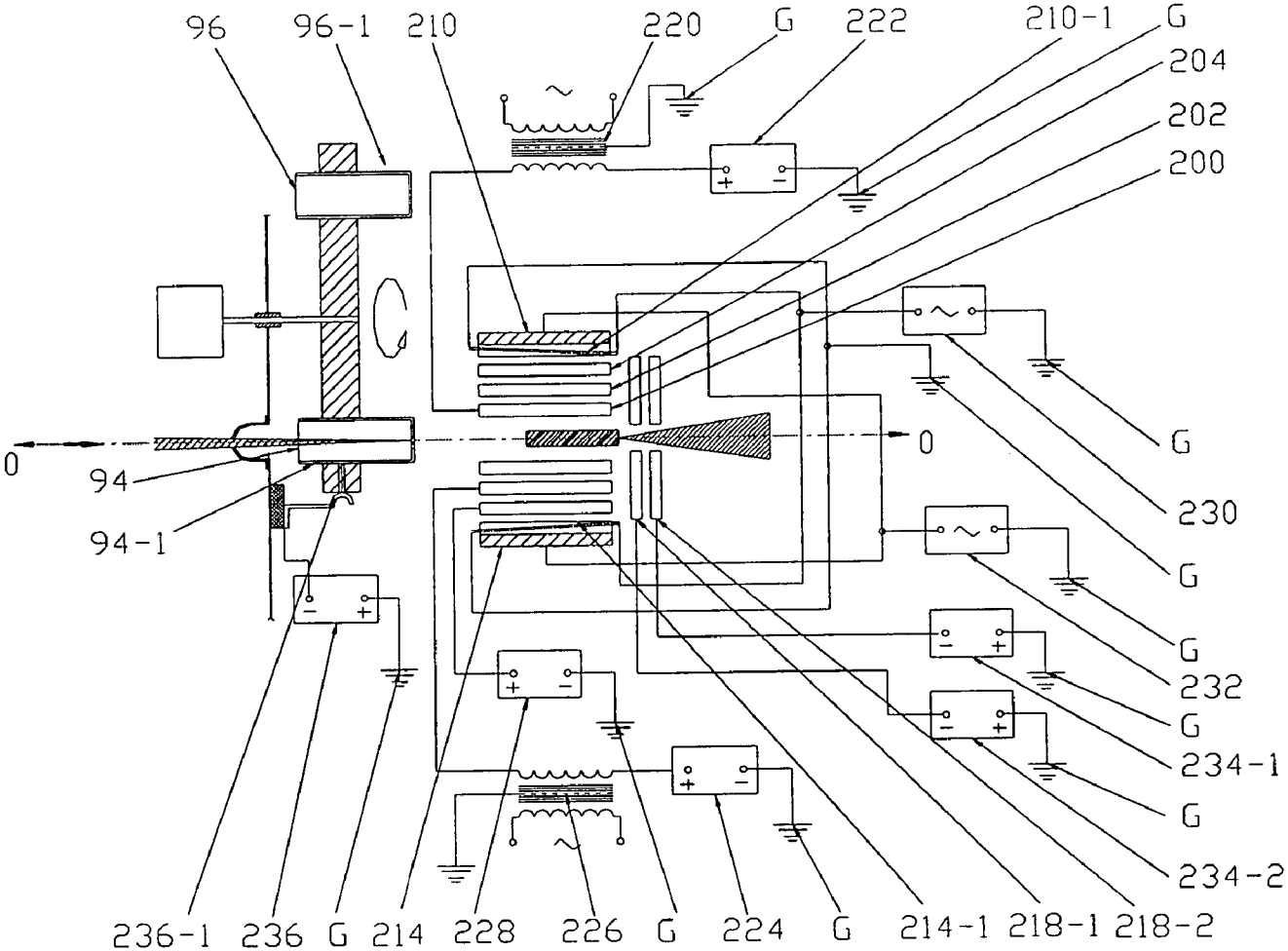
FIG. 4 is the same view as FIG. 3A but with addition of electrical connections.

The ionization device 26 used in the system S of the present invention is shown in FIGS. 3A, 3B and 4, wherein FIG. 3A is a longitudinal sectional view that illustrates arrangement of units in the device 26; FIG. 3B is a cross-sectional view along the line IIIB—IIIB of FIG. 3A; and FIG. 4 is the same view as FIG. 3A but with addition of electrical connections. The device contains the aforementioned rotary diaphragm-replacement system 86 located in a vacuum chamber 31 of the system S (FIGS. 1B) on the front end of the ionization device 26. Reduced pressure in the vacuum chamber 31 is provided by a vacuum pump 29.

As shown in FIGS. 3A and 4, the rotary diaphragm-replacement system 86 comprises a revolving carrier 88, with a plurality of circumferentially arranged and equally spaced recesses (only two of which, i.e., 90 and 92 are shown) for holding output orifices (only two of which, i.e., 94 and 96 are shown). In spite of the fact that the droplets D were passed through a system of stages 62 and 64 (FIG. 2) with sets of aerodynamic lenses for cleaning, sorting, sizing, and spacing, they still may contain some contaminants. Therefore in conventional aerosol mass spectrometers the final orifices are often contaminated and clogged to such an extent that it becomes necessary to discontinue operation of the mass spectrometer and to clean or replace the orifice at the entrance to the mass spectrometer. This condition is especially unacceptable for aerosol TOF MS's that are intended for continuous operation over a long period of time for collection of information under critical conditions of finding sources of hazardous contaminations, or the like. The above objective is achieved by the use of the aforementioned rotary diaphragm-replacement system 86. When the orifice 94 (FIG. 3A) is contaminated or clogged, the revolving disk-like carrier 88 performs indexing rotation to the next angular position for aligning the next final orifice of the system 86 with the axis of the orifice 80 of the capillary unit 80-1, so that operation of the system may continue without interruption.

The next unit of the ionization device 26 arranged in the direction of the particle flow comprises three coaxial cylindrical bodies (FIGS. 3A, 3B, and 4), i.e., a central cylindrical body 200, an intermediate cylindrical body 202, and an external cylindrical body 204. As shown in FIG. 4, all cylindrical bodies have four aligned longitudinal slits on their outer surfaces, which extend in the directions parallel to the central axis O—O of the cylindrical bodies. More specifically, the central cylindrical body 200 has slits 200-1, 200-2, 200-3, and 200-4; the intermediate cylindrical body has slits 202-1, 202-2, 202-3, and 202-4; and the external cylindrical body 204 has slits 204-1, 204-2, 204-3, and 204-4. Thus, the silts divide each cylindrical bodies into four concave segments with the concave sides facing the central axis O—O (FIGS. 3A, 3B, and 4).

Each three radially aligned slits of all three cylindrical bodies form an electrostatic slit lens. For example, the slits 200-1, 202-1, and 204-1 form an electrostatic slit lens 206; the slits 200-2, 202-2, and 204-2 form an electrostatic slit lens 208; etc.

The device 26 is provided with four elongated electron guns 210, 212, 214, and 216, which are located outside the external cylindrical body 204 in alignment with each set of three slits. The segments of the external electrodes 204 are connected to a positive terminal of a high-voltage power source (not shown) and serves as an anode for the aforementioned electron guns 210, 212, 214, and 216.

The slit lenses 206, 208, etc. focus each electron beam emitted by the respective electron guns 210, 212, etc. on the axis O—O of the ionization and beam-focusing unit 26. The slits 202-1, 202-2, 202-3, and 202-4 focus respective electron beams B1, B2, B3, and B4 (FIG. 3B) onto the axis O—O (FIG. 4) of the device 26 and decelerate the electrons for precise control of the ionization of particles to prevent partitioning. Each electron gun 210, 212, 214, and 216 consists of a tungsten filament (FIG. 3B) 210-1, 212-1, 214-1, and 216-1 immersed in the respective slit 210-2, 212-2, 214-2, and 216-2 of the control electrode on the respective electron gun 210, 212, 214, and 216.

The central cylindrical body 200, which is connected to a source of an adjustable potential positive relative to the filament, serves as an electron-energy control member for precisely controlling and selecting the energy of electrons that reach O—O axis. This is required for selecting such electron energy that provides the maximal cross section of ionization of the droplet substance.

Figure 5:
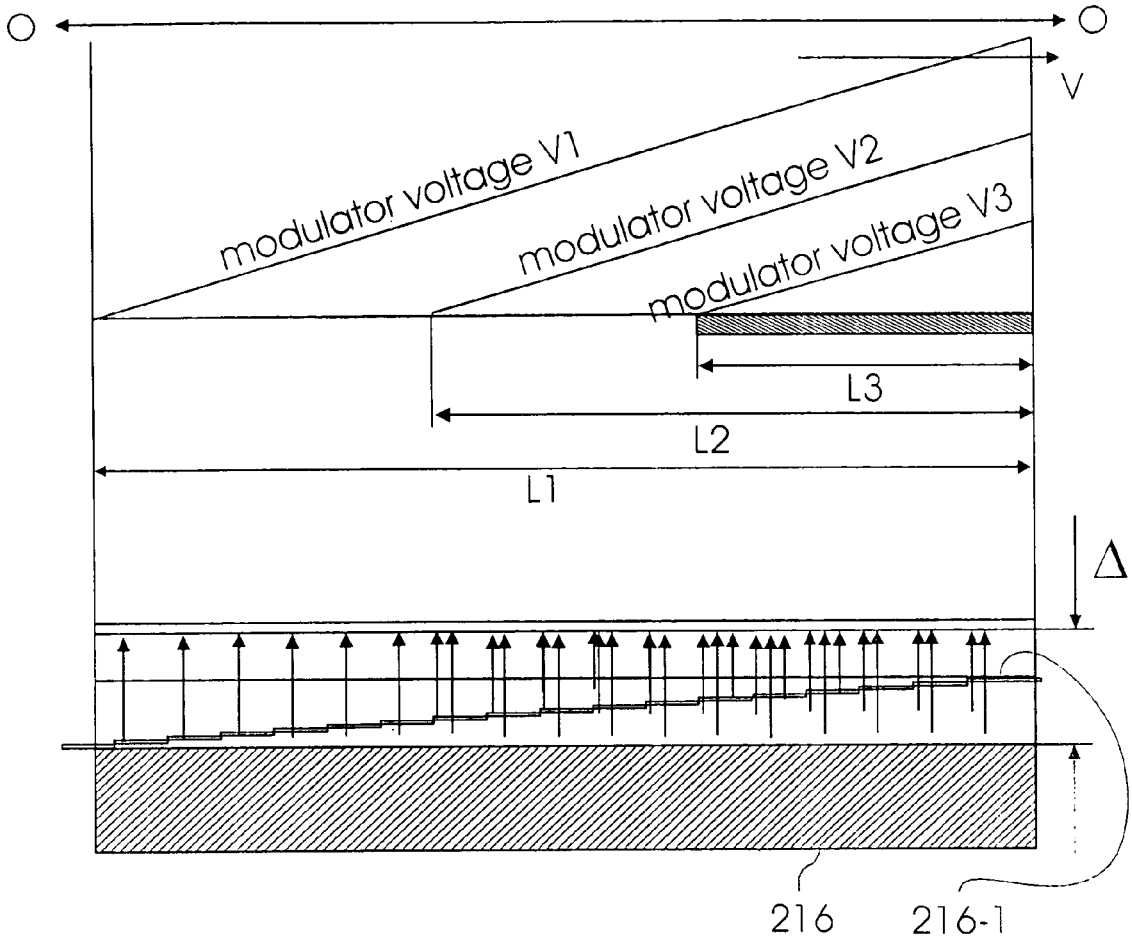
FIG. 5 is a graph illustrating change in the depth of immersion in the direction of flow of particles passing through the ionization device of FIGS. 3A, 3B, and 4.
Figure 6:
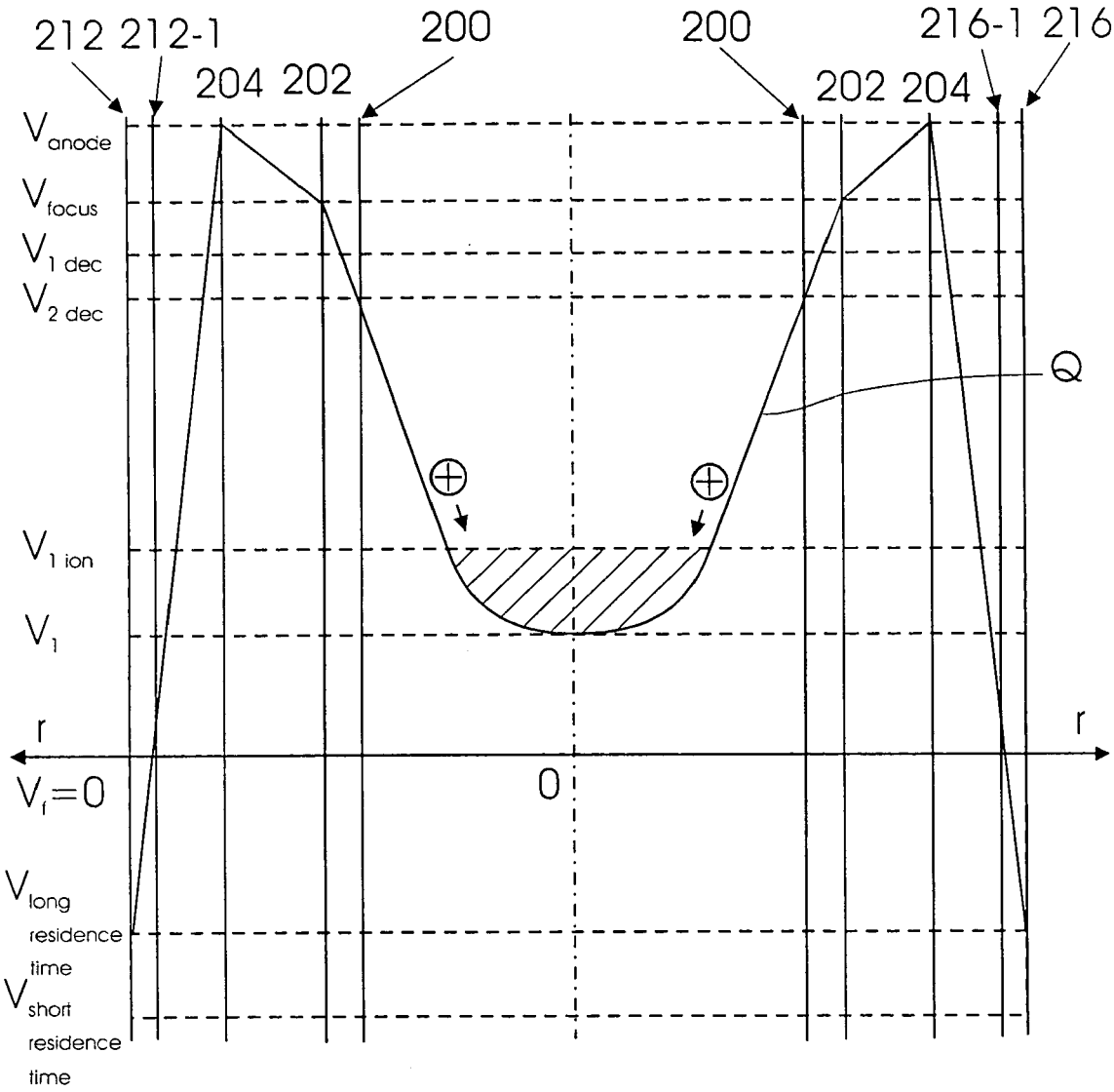
FIG. 6 is a graph that shows distribution of potentials on the three cylindrical bodies, electrodes of the electron guns, and in the flow of droplets in the ionization device of FIGS. 3A, 3B, and 4.

A small positive volume charge is formed along the axis O—O of the device 26. A radial gradient of this charge will depend on current of electrons, density of the focused beam in the vicinity of the axis, and the total density of the charges on the focused beams. Since in the ionization and beam-focusing unit 26 the current density can be adjusted by changing the aforementioned filament immersion, this feature allows stabilization of the space charge in the direction of axis O—O. This is very important, since the axial gradient developed by the increase in emission along the axis O—O secures the motion of ions with the low energy 0.04 eV in the right direction and prevents their storage in the device 26 as a source of the space spread which normally reduces sensitivity in conventional TOF-MS's. Due to the radial gradient of the density of the volume charge, particles of the aerosol beam D ionized by the electron beams B1, . . . B4 can roll down into the potential hole Q, which is shown in FIG. 6, whereby a narrow ion stream is formed. FIG. 5 is a graph illustrating changes in the depth of immersion in the direction of flow. It can be seen that the depth of immersion Δ decreases along the slit in the direction of droplets flow shown by arrow V. As a result, the electron emission and a radial electron current taken from a unit length of the filament increase in the direction of droplet propagation along the O—O axis. In fact, for a given flight velocity of particles through the zone of ionization, the length L3 shown in FIG. 5 corresponds to the length of the zone of ionization and defines the so-called residence time of a particle in the aforementioned zone of ionization. The residence time, in turn, defines probability of ionization. In the subsequent text, this characteristic will be described as "residence time".

For better understanding the effect of inclination of the tungsten filament (FIGS. 4 and 5) 210-1, 212-1, 214-1, and 216-1 on the residence time of the particles in the ionization portion of the device 26, let us refer to FIG. 5 and FIG. 6, wherein FIG. 6 shows distribution of potentials on aforementioned three cylindrical bodies 200, 202, and 204, on the electrodes of the electron guns 210, 212, 214, and 216, and in the flow of droplets D that passes along the axis O—O in the center of the central cylindrical body 200. Plotted on the abscissa axis of the graph of FIG. 6 are positions of the electrodes 200, 202, and 204 and of the respective pair of the electron guns in one of cross sections of the cylindrical bodies, e.g., in a cross-section shown in FIG. 4. The coordinate origin coincides with the position on the axis O—O. The ordinate axis of the graph of FIG. 6 shows time-averaged potentials on the electrodes 200, 202, and 204 at a certain moment of time (some of the electrodes are supplied with modulated high voltage and with a low depth of modulation).

As shown in FIG. 4, the central cylindrical body or central electrode 200 is connected via a winding of a modulation transformer 220 to a positive terminal of a high-voltage DC power supply unit 222. In order to impart to the slits 202-1, 202-2, 202-3, and 202-4 combined with the anode slits 204-1, 204-2, 204-3, and 204-4 the aforementioned focusing functions, the intermediate cylindrical body is connected to an adjustable high-voltage power supply 224. A positive terminal of the adjustable high-voltage power supply 224 is connected to the intermediate cylindrical body 202 via the winding of a modulation transformer 226. Frequency of modulation via the transformers 220 and 226 can vary in a wide frequency range, e.g., from several Hz to several KHz. The external cylindrical body or electrode 204 is connected to the positive terminal of an adjustable high-voltage power supply 228. All negative terminals of the aforementioned power supplies are grounded. The tungsten filaments 210-1, 212-1, 214-1, and 216-1 (only two of which, i.e., 210-1 and 214-1, are shown in FIG. 4) are connected to a source of AC voltage 230.

Bodies of electron gun 210, 212, 214, and 216 with respective slits 210-2, 212-2, 214-2, and 216-2 are made in the form of Wehnelt electrodes (only two of which, i.e., 210 and 214, are shown in FIG. 4). These electrodes are supplied with a modulation AC voltage from an AC voltage supply 232 (FIG. 4).

The aforementioned orifice 94 of the rotary diaphragm-replacement system 86 (FIG. 4) serves as an entrance diaphragm of the ionization device 26, while the set of two diaphragms 218-1 and 218-2 is used as an outlet of the ionization device 26 composed of the aforementioned three cylindrical bodies 200, 202, and 204 with the electron guns 210, 212, 214, and 216. These entrance and outlet diaphragms are maintained under a potential of a negative volume charge in order to prevent penetration of the external electrical fields into the ionizer and thus to prevent extraction of slow electrons from the space charge. This is important since such electrons compensate for the aforementioned space charge of positive particles. The diaphragms 218-1 and 218-2 are electrically interconnected and connected to the negative terminal of a DC power supply 234. The positive terminal of the power supply 234 is grounded.

The aforementioned output orifices (only two of which, i.e., 94 and 96 are shown in FIGS. 3A and 4) are formed in metal sleeves, which are connected to a negative terminal of a power supply 236 via a sliding current collector 236-1. This potential fulfils the same function and the potential supplied to the diaphragms 218-1 and 218-2.

Thus, the ionization device transforms the flow of substantially neutral droplets D that enter this device into a slightly diverged flow of ionized droplets D. For matching with the entrance of the aerosol TOF MS unit 32 of the system S of the invention, the flow of ionized droplets D should be focused, aligned, and time-modulated, with the TOF MS entrance.

The electron guns 210, 212, 214, and 216, filaments 210-1, 212-1, 214-1, and 216-1 aligned relative to the respective longitudinal slits 210-2, 212-2, 214-2, and 216-2 and inclined relative to the longitudinal axis, and source 230 of heating the filaments form means for adjusting the length L3 (FIG. 5) of the zone of ionization to conditions most optimal for the analyzed droplets. The aforementioned means for adjusting the length L3 provides a single-event ionization substantially of each of the particles since the length L3 is adjusted with reference to the velocities, compositions, natures, and masses of the particles. The term "single-event collision" means that the particles will not collide with the electron for the second time during the time of residence.

All devices of the aerosol TOF MS unit 32 operating in conjunction with the ionization device 26 of the present invention are located in a high-vacuum chamber 33 of the unit 32, which is evacuated with the use of a vacuum pump 35 (FIG. 1B).

The functions of focusing, aligning, and time-modulating the ionized flow of droplets with the aerosol TOF MS unit 32 are accomplished by means of an ion-optic system 30 and a deflector modulator 239 with a steering deflector 238 (FIG. 1B) which provides alternating deflections of the flow of particles between two positions F1 and F2 for aligning the flow with two inlet openings 256 and 258 into the TOF MS 32.

The ionization device 26 of the present invention operates as follows.

Since the mass spectrometer 32 for which the ionization device 26 is intended operates in a continuous mode, it is assumed that all parts of the system, including the ionization device, are energized, i.e., electron guns 210-2, 212-2, 214-2, and 216-2 are activated, the respective filaments 210-1, 212-1, 214-, and 216-1 are heated by resistance heat, and appropriate voltages are applied to the segments of the concentric cylindrical bodies that form the ionization unit so that electron beams that are intended for ionization of the droplets are formed and delivered to the ionization zone.

After passing through a system of stages 62 and 64 (FIG. 2) with sets of aerodynamic lenses for cleaning, sorting, sizing, and spacing, the droplets of the sample which is to be ionized are directed into the ionization device 26 through the orifice 94 of the rotary diaphragm-replacement system 86 which is aligned with the central longitudinal axis O—O of the ionization device (FIGS. 3A and 4).

When the flow of droplets D passes in the O—O axis direction through the ionization device 26, the droplets are subjected to the action of electron beams emitted by the electron guns 210-2, 212-2, 214-2, and 216-2 and directed onto the flow of particles by radially arranged slit lenses 206, 208, etc. that focus the electron beams onto the flow of droplets and decelerate the electrons for optimization of their energy by applying an appropriate voltage to the slits of the internal cylindrical body 200.

As has been mentioned above, the central cylindrical body 200, which is connected to a source of an adjustable potential positive relative to the filament, serves as an electron-energy control member for precisely controlling and selecting the energy of electrons that reach O—O axis. This is required for selecting such electron energy that provides the maximal possible cross section of ionization of the droplet substance.

The magnitudes of voltages or potentials developed in the slits between the segments of the cylindrical bodies are shown in FIG. 6, where potentials applied to the electrodes are plotted on the ordinate axis and where abscissa axis shows positions of the slits formed by the electrodes relative to the O—O axis. The center of the coordinate (point O) is located in the center of the graph. Thus, the vertical lines which are arranged symmetrically on the right side and on the left side from the center of coordinate correspond respectively to the electrodes formed by the inner cylindrical body 200, the focusing electrode 202, the external anode electrode 204, the filaments 216-1 and 212-1, and the Wehnelt electrodes 216 and 212. The curve Q in FIG. 6 corresponds to distribution of the potential on all electrodes of the ionization device 26 (potential hole).

In FIG. 6, $V_f$ designates a constant zero potential on the electron-gun filaments; $V_{anode}$ designates a positive potential on the electrodes formed by the external cylindrical body (anode) 204; $V_{focus}$ designates a positive potential on the electrode formed by the intermediate cylindrical body 202; $V_{2\ dec}$ designates a positive potential on the electrodes formed by the inner cylindrical body (decelerator) 200; and $V_{1\ dec}$ shows the maximal range of variation of $V_{2\ dec}$.

The curve Q of FIG. 6 shows that distribution of potential in the radial direction of the ionization device 26 forms a typical potential hole for ions localized in the area defined by the walls of the potential hole which in FIG. 6 is represented by the curve Q. The ions generated by the collision of the electrons with the droplets are accumulated in the area limited by the curve Q. This will lead to the growth of a positive spatial charge. In the graph of FIG. 6, the value of the positive space charge is designated by $V_{1\ ion}$. If in the course of collision of the electrons with the droplets the concentration of ions in the potential hole could grow, $V_{1\ ion}$ would move towards the edges of the potential hole, i.e., toward $V_{anode}$. However, this does not take place for the followings reasons: since once collided, the electrons loose their energy; and collision also results in release of a slow electrons, a part of which may remain in the potential hole over an extended period of time. The electrons accumulated in the potential hole compensate a positive spatial charge created by the ions in the potential hole. However, they cannot provide complete compensation, and the flow of charged particles formed in the ionization device 26 has a small positive potential $V_{1\ ion}$ that normally does not exceed 10 V. In other words, $V_{1\ ion}$ is essentially lower than the potential on the edges of the potential hole, where $V_{anode}$ is about 100 V.

In order to impart to the slits 202-1, 202-2, 202-3, and 202-4 in combination with the anode slits 204-1, 204-2, 204-3, and 204-4 the aforementioned focusing functions, the intermediate cylindrical body 202 (FIG. 4) is connected to an adjustable high-voltage power supply 224. A positive terminal of the adjustable high-voltage power supply 224 is connected to the intermediate cylindrical body 202 via the winding of a modulation transformer 226. Frequency of modulation via the transformers 220 and 226 can vary in a wide frequency range, e.g., from several Hz to several KHz.

Variation of the positive potential on the intermediate cylindrical body 202 with the use of the modulation transformer 226 provides variation of focusing properties of the focusing lenses formed by the respective anodes of the external cylindrical body 204, the intermediate electrode 202 with respective anode slits 204-1, 204-2, 204-3, 204-4, and the intermediate electrode slits 202-1, 202-2, 202-3, 202-4. Variations in the position of the focus makes it possible to scan the flow of particles in the radial direction and in the plane of the flat electron beam.

Variation of the positive potential on the inner cylindrical body (decelerator) 200 with the use of the modulation transformer 220 provides variation of energy of electrons that entered the ionization zone inside the beam. This is because, depending on the mass, the particles to be charged will have different values of cross-sections of ionization and their energy dependence. Therefore, sweeping of the ionization energy will optimize the process of ionization.

Thus the ionization device 26 of the present invention maintains the flow of ionized particles in the state of equilibrium and stabilizes this flow in the radial direction. In order to limit the loss of the aforementioned slow electrons that compensate for the spatial charge of the ionized particles, it is necessary to prevent leakage of the electrons in the axial. In the device 26 of the invention, this is achieved by applying negative voltages to the units arranged on the end faces of the ionization unit, i.e., from the power supply 236 to the orifice 94 of the rotary diaphragm-replacement system 86 via the sliding contact 236-1 and from the power supply 234 to the diaphragms 218-1 and 218-2, which are used as an outlet of the ionization device 26.

As has been described above, when the flow of droplets passes through the ionization device, the residence time of the droplets is controlled via the amplitude of modulation of potential applied to the Wehnelt electrode.

Thus, the ionization device 26 transforms the flow of substantially neutral droplets D that enters this device into a slightly diverged flow of ionized droplets D that are emitted from the outlet of the ionization device to entrance of the aerosol TOF MS unit 32. This flow of ionized droplets D should be focused, aligned, and time-modulated, with the TOF MS entrance.

The functions of focusing, aligning, and time-modulating the ionized flow of droplets with the aerosol TOF MS unit 32 are accomplished by means of an ion-optic system 30 and a deflector modulator 239 with a steering deflector 238 (FIG. 1B) which provides alternating deflections of the flow of particles between two positions F1 and F2 for aligning the flow with two inlet openings 256 and 258 into the TOF MS 32. As has been mentioned above, these units are beyond the scope of the present invention.

TOF MS Unit

The functions of focusing, aligning, and time-modulating the ionized flow of particles with the aerosol TOF MS unit 32 are accomplished by means of an ion-optic system 30 and a deflector modulator 239 with a steering deflector 238 (FIG. 1B) which provides alternating deflections of the flow of particles between two positions F1 and F2 for aligning the flow with two inlet openings 256 and 258 into the TOF MS 32. These units will now be considered in more detail.

Figure 7:
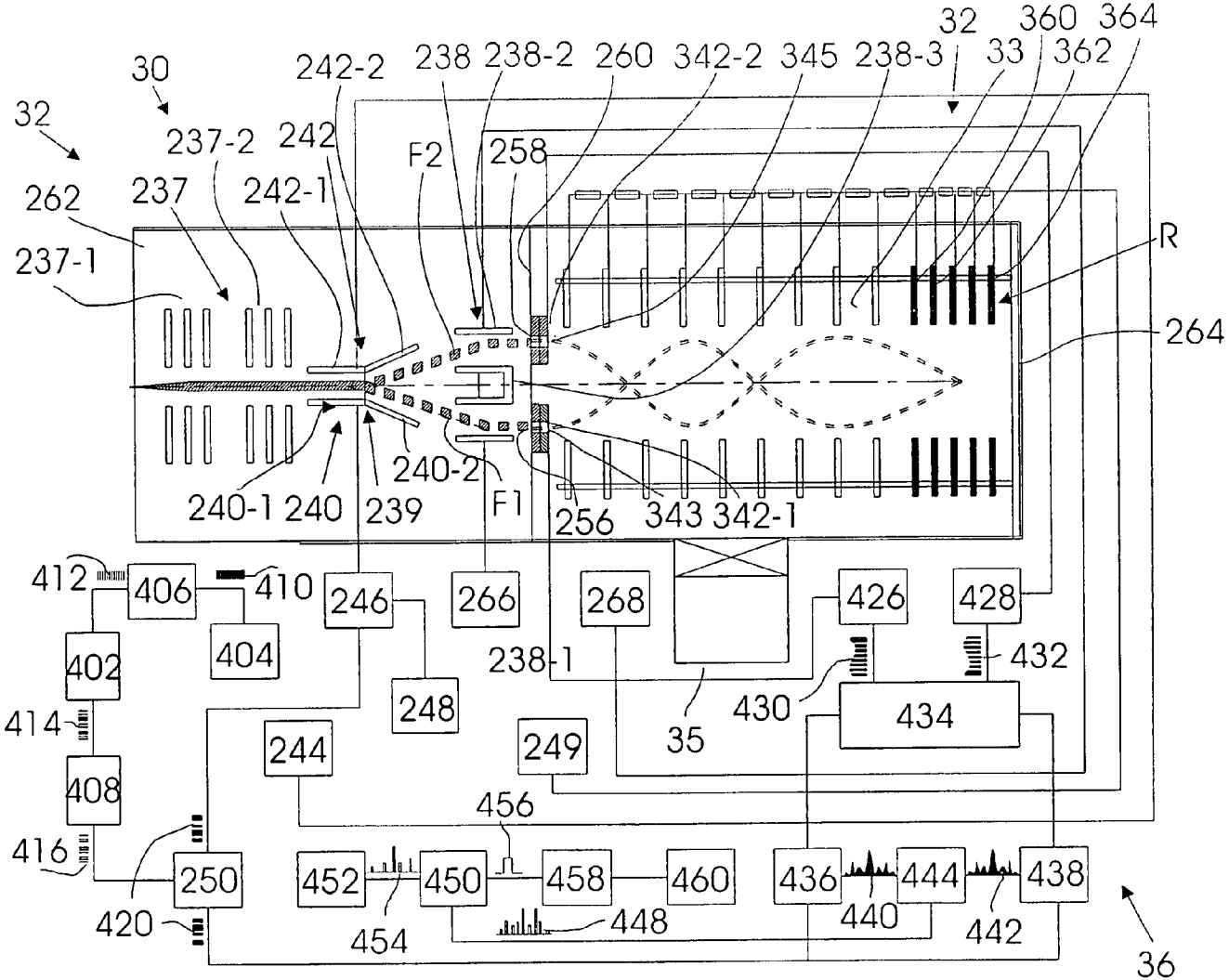
FIG. 7 is a schematic sectional view that illustrates the ion mass separation chamber with the ion-optic system and deflector modulator on the entrance side of the TOF MS of FIG. 1.

The functions of focusing, aligning, and time-modulating the ionized flow of particles with the aerosol TOF MS unit 32 are accomplished by means of focusing lenses 237, and a deflector modulator 239 (FIG. 1B and FIG. 7). FIG. 7 is a schematic longitudinal sectional that illustrates the arrangement of the focusing lenses 237, the deflector-modulator 239, and of the TOF MS unit 32 in connection with the ionization device 26 and the data acquisition and analysis unit 36.

This focusing lenses 237 comprises two set 237-1 and 237-2 of diaphragms, three in each set, that transform the ionized flow of particles D with slight divergence into a parallel flow and direct this flow into the entrance of the deflector-modulator 239. In the embodiment illustrated in FIGS. 1B and 7, the continuous parallel flow of ionized particles D is alternately deflected by the aforementioned deflector-modulator 239 that consists of two plates 240 and 242. Portions 240-1 and 242-1 of the of the plates 240 and 242, which are located at the input side of the deflector-modulator 239, are parallel to each other, while portions 240-2 and 242-2 of the plates located at the output side of the deflector-modulator 239, diverge towards the TOF MS 32. One plate of the deflector-modulator 239, e.g., the plate 242, is connected to a DC power supply 244 that provides the deflection of the ion beam with angle $\alpha$. The opposite plate 240 is connected through a switcher 246 to a DC power supply 248 that provides deflection of the ionized flow of particles D with angle $2\alpha$, but in the opposite direction.

This switcher 246 is connected to the random pulse modulation system 250 that generates the irregular sequence of switching pulses to split by the deflector unit 239 the continuous flow of ionized particles D into two discontinuous flows F1 and F2 (FIG. 7). Each part of ion flow is directed by the deflector-modulator 239 to a respective steering deflector 238-1 and 238-2 with a mutual grounded electrode 238-3 that is designed as a rectangular box with a blind hole in the middle.

The steering deflectors 238-1 and 238-2 have a permanent potential to correct trajectories of the component flows F1 and F2 and direct them in apertures 252 and 254 of diaphragms 256 and 258 in a barrier 260 between an MS vacuum chamber 262 and a TOF-MS drift tube 264. The DC voltages on the steering deflectors 238-1 and 238-2 relative to the common electrode 238-3 are applied from adjustable DC power supplies 266 and 268, respectively (FIG. 7).

Thus, the deflector-modulator 239 forms two separate flows F1 and F2 of ionized particles by chopping a single flow of ionized particles that arrives from the ionization device 26. Division of a continuous flow of particles into several separate flows for different inputs to the TOF MS unit is an unique feature of the apparatus of the invention, since it allows simultaneous flights of particles along two non-interfering trajectories with individual spatial distribution of particles and with independent data processing of this data in independent channels. Division of the continuous flow only into two separate flows F1 and F2 was shown only for the sake of simplicity of explanation and drawings. It is understood that the single flow can be divided into more than two separate flows, if particles of each flow can be unequivocally identified.

One of the most important parts of the aerosol TOF MS 32 is an electrostatic spiral quadrupole ion optics unit 270, which hereinafter will be referred to as a spiral quadrupole optics. Although with some differences, this unit is described in U.S. patent application Ser. No. 058153 filed by one of the applicants of the present application in 2002. Since the spiral quadrupole optics 270 plays an important role in the aerosol TOF MS 32, this unit will now be describe in detail.

Figure 8:
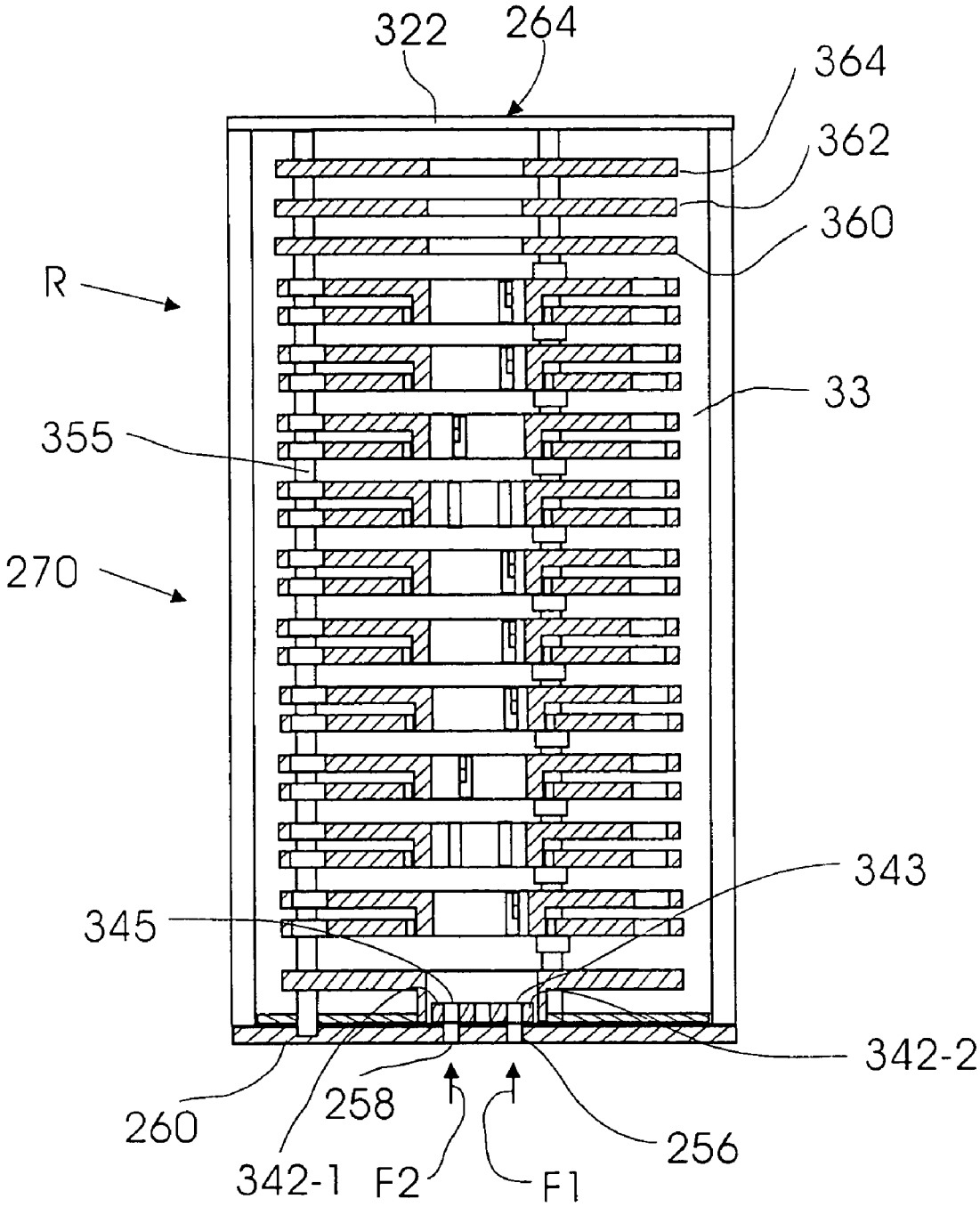
FIG. 8 is a longitudinal sectional view of the ion mass separation chamber of the aerosol TOF MS of the present invention.

The aerosol TOF MS 32 with the spiral quadrupole optics 270 is shown in FIG. 6, which is a longitudinal sectional view of this unit. The aerosol TOF MS 32 has a sealed housing 322 (FIG. 8), in which in the direction of propagation of the particles the spiral quadrupole optics 270 is located after the set of the focusing lenses 237, deflector-modulator 239, steering deflectors (238-1, 238-2, 238-3), and diaphragms 256 and 258 (FIG. 7). FIG. 8 is a longitudinal sectional view of the ion mass separation chamber of the aerosol TOF MS of the present invention.

Furthermore, in contrast to aforementioned previous patent application Ser. No. 10/058,153, the TOF MS 32 does not have a separate electron-emission screen and separate micro-channel plates. In the device of the invention, functions of both these units are accomplished by micro-channel plate detectors 342-1 and 342-2. Although only two such detectors are shown and described with reference to FIGS. 7 and 8, a plurality of such detectors can be used, one for each injector. Since the micro-channel plate detectors 342-1 and 342-2 are applied onto the diaphragms 256 and 258, in order to provide unobstructed passage of the particle flows F1 and F2, the micro-channel plate detectors 342-1 and 342-2 have openings 343 and 345, which are aligned with respective diaphragms 256 and 258. Thus, the input injectors of the spiral quadrupole optics 270 are formed by the diaphragms 256, 258 and openings 343, 345. The surface of the micro-channel plate detectors, except for the openings, works as a single-stage detector for ions and charged particles.

Figure 9:
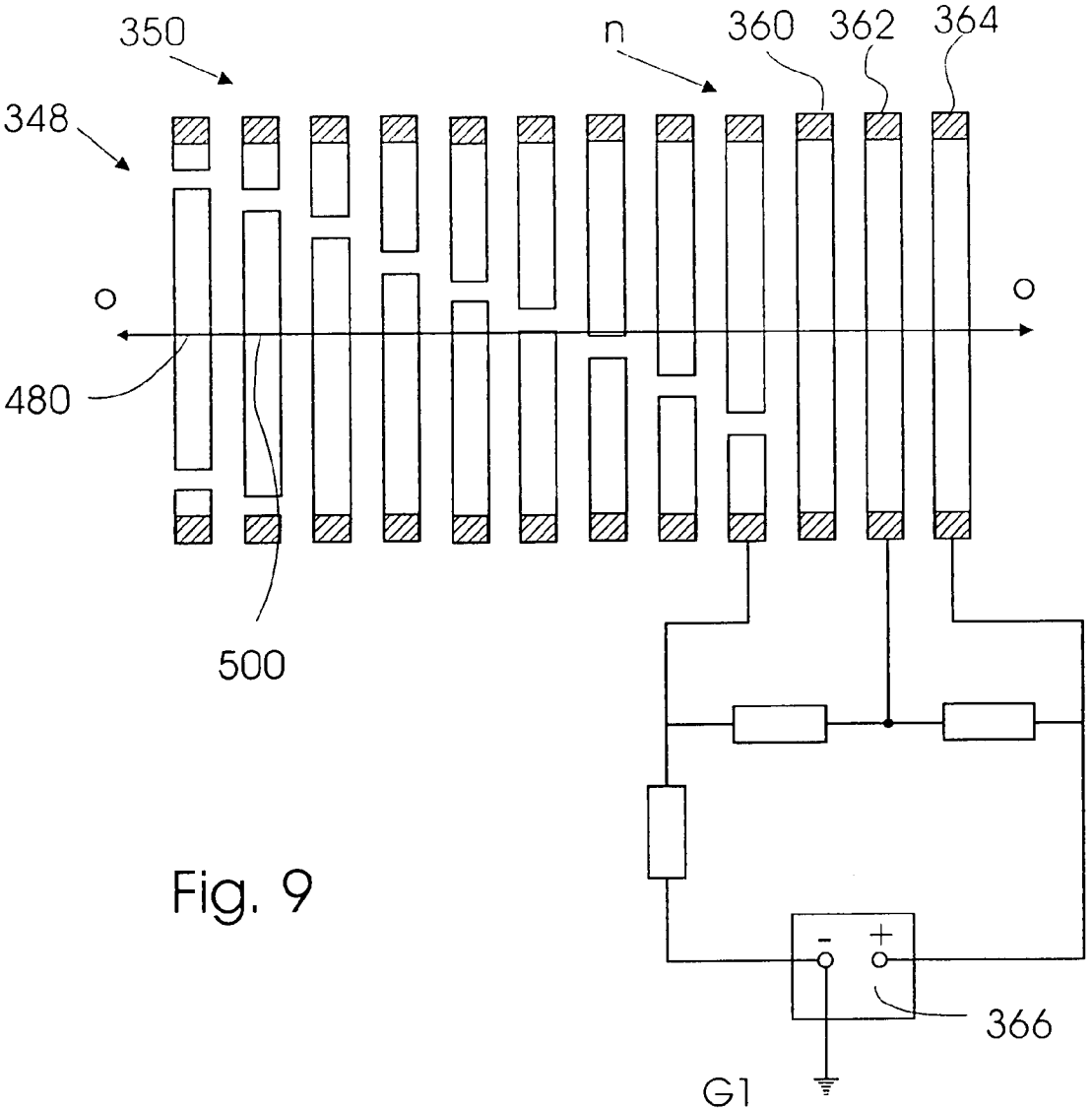
FIG. 9 is an axial sectional view of the electrostatic lens assembly.
Figure 10:
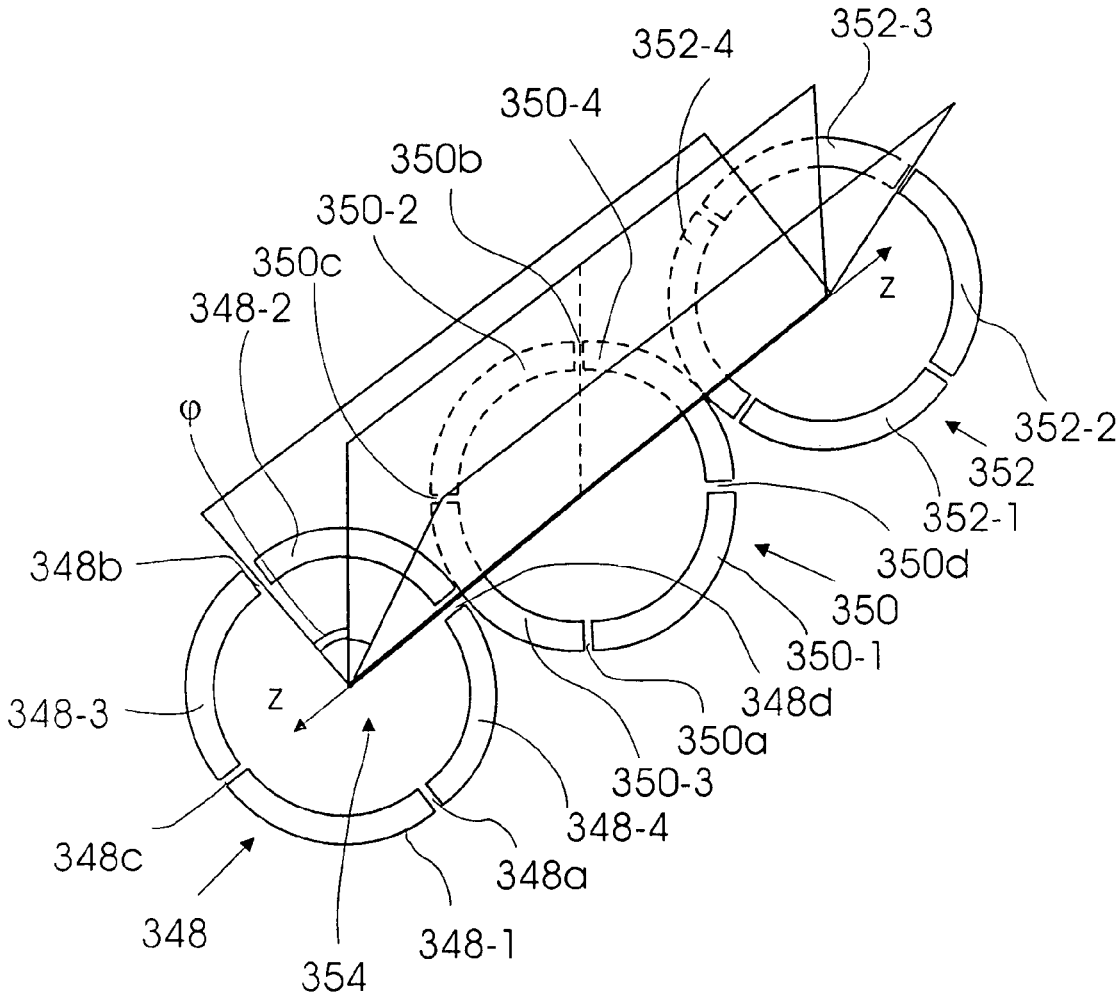
FIG. 10 is a three-dimensional view of three sequential quadrupole lenses illustrating angular shift of the poles.

The spiral quadrupole optics 270 contains a series of sequentially arranged quadrupole electrostatic lenses 348, 350, . . . FIG. 9 is an axial sectional view of the electrostatic lens assembly composed of the aforementioned lenses 348, 350, . . . , and FIG. 10 is a three-dimensional view of three sequential quadrupole lenses illustrating angular shift of the poles. The assembly shown in FIG. 9 consists of nine lenses, which are shown in this quantity only as an example. As can be seen from FIGS. 9 and 10, each lens consists of four equally spaced arch-shaped poles. More specifically, the quadrupole lens 348 consists of poles 348-1, 348-2, 348-3, and 348-4, the quadrupole lens 350 consists of four equally-spaced arch-shaped poles 350-1, 350-2, 350-3, and 350-4, the quadrupole lens 352 consists of four equally-spaced arch-shaped poles 352-1, 352-2, 352-3, and 352-4, etc. (other lenses are nor shown). Each lens has a central opening, so that in combination these openings form a central ion-guiding channel 354. In each circular quadrupole lens, the poles are separated in the circumferential direction by gaps, i.e., by gaps 348*a*, 348*b*, 348*c*, and 348*d* in the quadrupole lens 348, by gaps 350*a*, 350*b*, 350*c*, and 350*d* in the quadrupole lens 350, etc.

As can be seen from FIGS. 9 and 10, the quadrupole lenses of the assembly are shifted angularly with respect to each other to an angle equal to 360° divided by the number of the circular lenses in the assembly. In the embodiment of the spiral quadrupole optics 270 shown in FIGS. 7–10, the angular shift of the poles and gaps of each sequential circular quadrupole lens with respect to the preceding lens is equal to 360°/9=40°. It is understood that these numbers are given only as an example and that the number of circular quadrupole lenses and hence the angular shift could be different.

The purpose of the aforementioned angular shift between the poles of the sequential quadrupole lenses 348, 350, . . . is to create specific electrostatic quadrupole fields in axial spaces between the planes of the adjacent lenses. These gradient fields are arranged along the ion-guiding channel 354 in the direction of propagation of ions emitted from the ionization device 26 (FIG. 1B), i.e., along the longitudinal axis O—O (FIGS. 9 and 10). The aforementioned electrostatic quadrupole fields are characterized by an angular gradient with the angle measured in planes perpendicular to the axis O—O or parallel to the planes of the lenses. In combination, the aforementioned specific electrostatic quadrupole fields can be considered as a single helical electrostatic quadrupole field.

Figure 11:
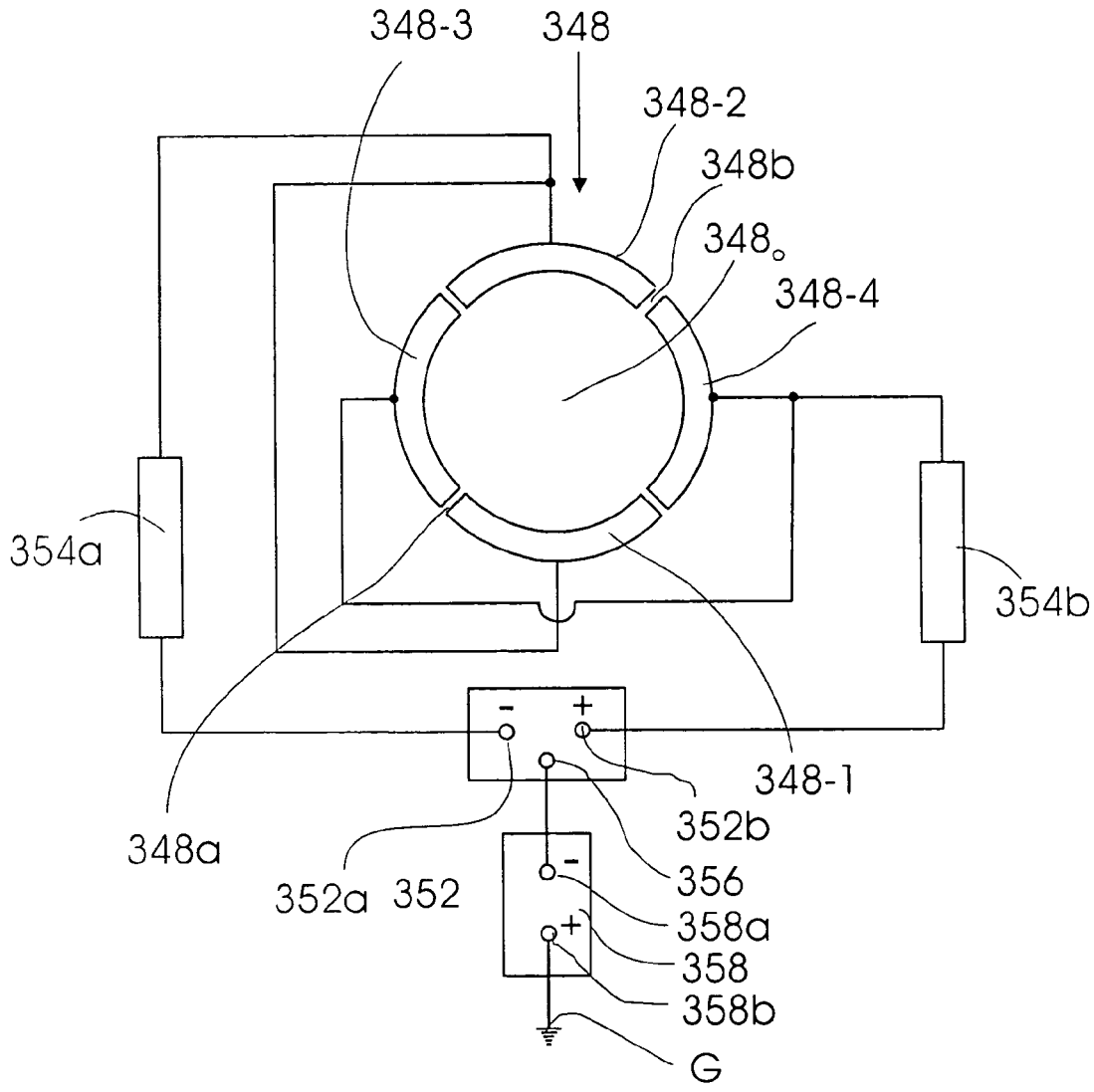
FIG. 11 is an electric circuit illustrating application of electric potentials to the poles of one of the circular electrostatic quadrupole lenses of the assembly shown in FIG. 9.

The aforementioned helical electrostatic quadrupole field can be realized with an application of respective electric potentials to the poles of the sequential circular quadrupole lenses. FIG. 11 shows an electric circuit illustrating application of electric potentials to the poles of one of the circular electrostatic quadrupole lenses, e.g., the lens 348. As can be seen from FIG. 11, the lens 348, as well as any other lens of the assembly, consists of two pairs of diametrically opposite poles receiving equal potential. Thus, in FIG. 11, the first pair consists of the poles 348-1 and 348-2 connected to a negative terminal 352*a*, while the second pair consists of the poles 348-3 and 348-4 connected to a positive terminal 352*b* of a power source 352. Each pair the poles is connected to the respective terminal via an electric resistor, i.e., a resistor 354*a* for the poles 348-1 and 348-2, and a resistor 354*b* for the poles 348-3 and 348-4. In the example shown in FIG. 11, the power source 352 has −20V on its negative terminal 352*a* and +20V on the positive terminal 352*b*. The midpoint 356 of the power source 352 is connected to a negative terminal 358*a* of a high-voltage power source 358, the positive terminal 358*b* of which is grounded at G. In the embodiment shown in FIG. 11, the terminal 358*a* of the high-voltage power source 358 has a potential of −4.5 kV.

Each successive circular quadrupole lens of the lens assembly has the potential application circuit the same as the one shown in FIG. 11, with the exception that the poles are angularly shifted by angle equal to 360° divided by the number of the circular lenses in the assembly. In the embodiment of the invention shown in FIGS. 7–10 with nine lenses, the shift angle will be equal to 40°. Another distinction of the circuits in the sequential lenses is that the potential on the negative terminals (that correspond to the terminal 358*a* of the source 358 in FIGS. 10 and 11, will be reduced in each lens by 500V in the direction of propagation of the ions. Thus, if the first lens 348 has on the terminal 358*a* of the high-voltage source 358 a negative potential of −4.5 kV, then in the second lens 350 a respective terminal will have a potential equal to −4 kV, etc. More specifically, the central point (such as point $\mathbf{348}_0$ of the lens 348 shown in FIG. 11) will have a potential equal to −4.5 kV in the lens 348, −4 kV in the lens 350, −3.5 kV in the next lens, and finally, the last lens will have a potential equal to 0.

Figure 12:
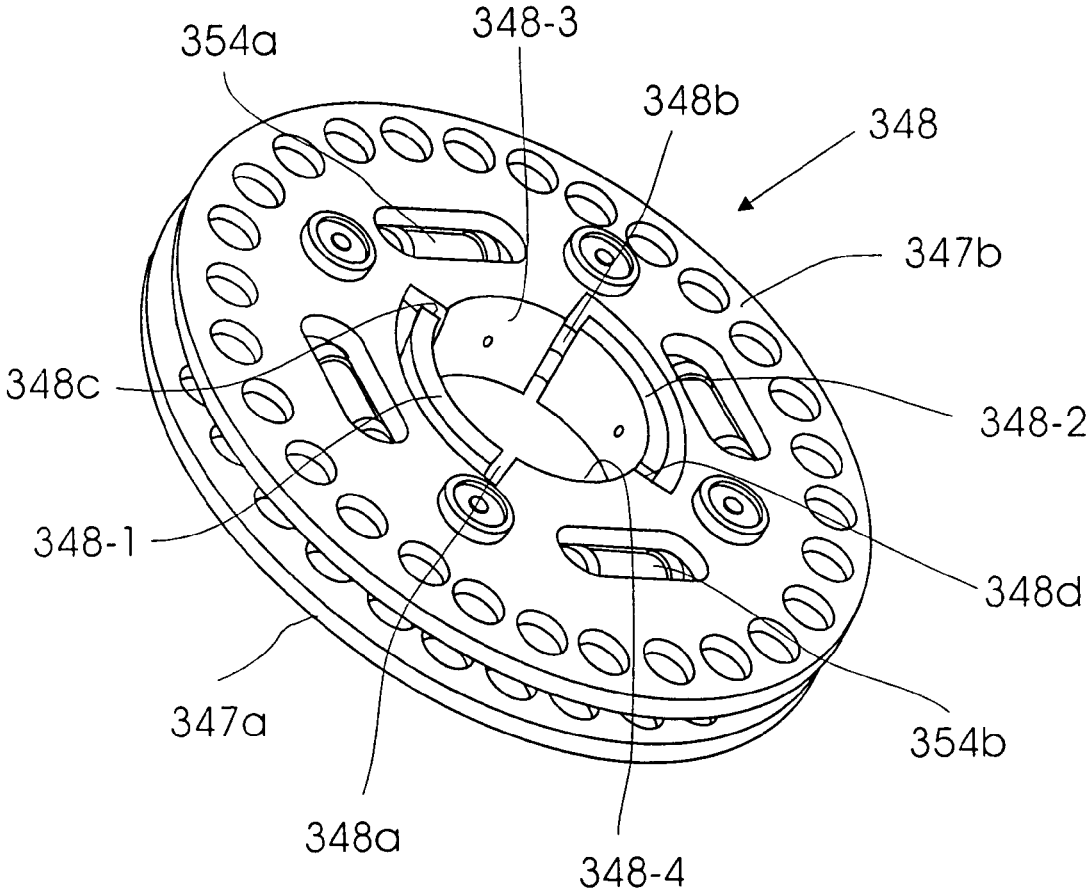
FIG. 12 is a three-dimensional view illustrating the construction of one of the electrostatic quadrupole lenses.
Figure 13:
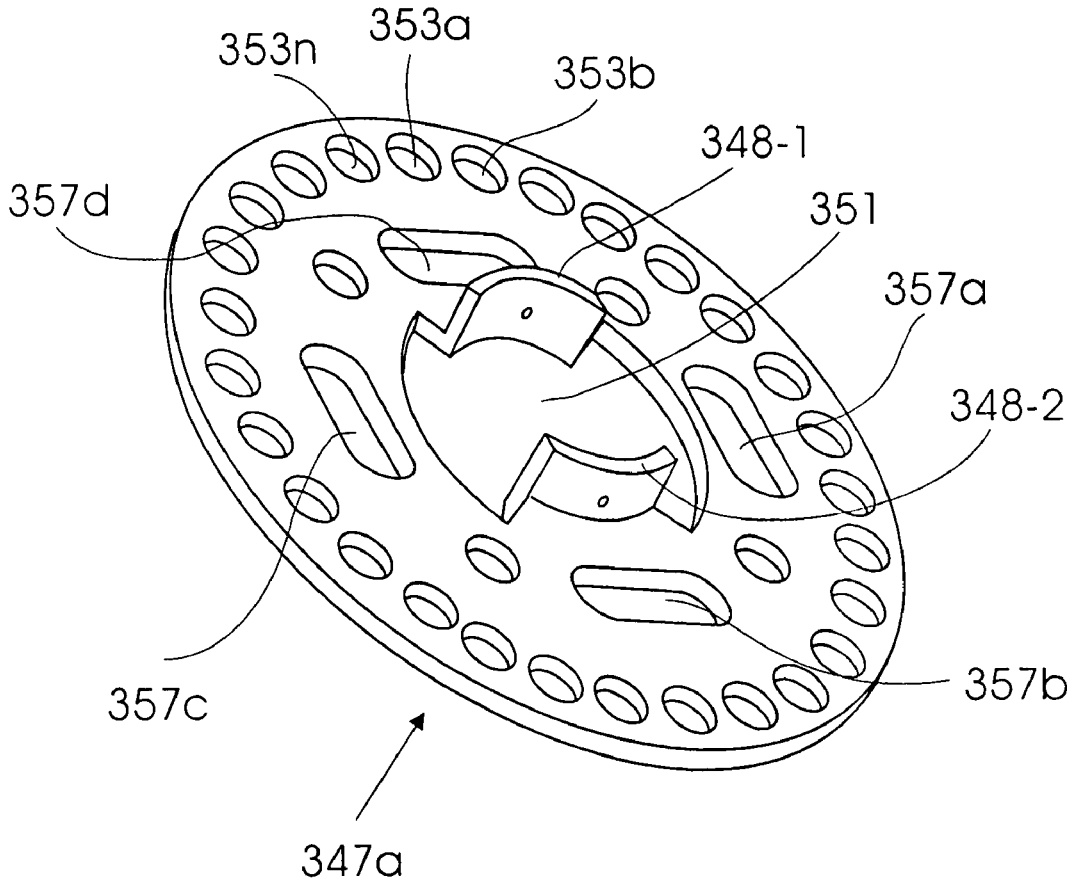
FIG. 13 is a three-dimensional view of one of component disks from which the lens is assembled.

FIG. 12 is a three-dimensional view illustrating the construction of one of the electrostatic quadrupole lenses, e.g., the lens 348. FIG. 13 is a three-dimensional view of one of standard component disks from which the lens 348, as well as all other lenses of this unit, is assembled. More specifically, it is advantageous to assemble each electrostatic quadrupole lens from two identical disks 347*a* and 347*b* (only one of these disks, i.e., the disk 347*a* is shown in FIG. 13). The disk 347*a* has a central opening 351 with two diametrically opposite arch-shaped axial projections that will be used as poles 348-1 and 348-2. Openings 353, 353*b*, . . . 353*n* are needed for assembling and of the electrostatic quadrupole lenses within the spiral quadrupole optics 270 by means of dielectric, e.g., ceramic, rods (only one of these rods 355 is shown in FIG. 6 in order to simplify the drawing). Oval windows 357*a*, 357*b*, 357*c*, and 357*d* are used for accommodation of resistors 354*a*, 354*b* (FIG. 11 ). As shown in FIG. 12, the lens 348 is easily formed by imposing the disk 347*a* onto the disk 347*b* in mirror positions of both disks and with angular shift of projections 348-1, 348-2 of disk 347*a* relative to the projections 348-3 and 348-4 by 90°. The disks are isolated from each other by ceramic spacers (not shown). In FIG. 11, reference numerals 348*a*, 348*b*, 348*c*, and 348*d* designate the respective gaps, and reference numeral 354*a* and 354*b* designate electric resistors.

In each lens the absolute value of the potential difference between each pair of diametrically opposite poles is equal to 40 V (i.e., [−20V+(−20V)]. Furthermore, in each subsequent lens in the direction of propagation of the ions the potential in the center of the lens will be reduced. It is well known that in an electric field charges s move in the direction of the field gradient. Therefore in the aforementioned helical electrostatic quadrupole field, the ions will move along helical trajectories. Such trajectories are well known for movement of electrons in electron cyclotron resonance (ECR) as well as in the Penning plasma. However, in ECR and in the Penning plasma, the aforementioned helical movement of electrons has an entirely different physical nature and is caused by the drift of the charge in a magnetic field. In the of our invention, however, the helical trajectory of positively-charged ions results from a specific structure of the electric field in the absence of the magnetic field. Therefore, the aforementioned helical movements should not be confused.

Since the potential on the first lens 348 is negative, on its way in the propagation direction the positively charged ion will be first accelerated by being attracted due to the negative potential on the lens 348. Such acceleration will be continued for a predetermined point on the path of the ion. However, in the course of its continuing movement, the ion will experience the pulling force developed by negative potentials of those lenses, which are left behind the ion. These forces will pull the ions back towards the ionization device 26 (FIG. 8) and thus will gradually decelerate the ion. It also should be noted that the forces acting on all ions will be the same for equally charged ions. However, since ions of different substances have different masses, those ions which have low masses will fly through the spiral quadrupole optics 270 for a shorter time than those ion that are heavier. This is the so-called time-of-flight principle used for identification of ions in time-of-flight type mass spectrometers. As has been described earlier in the review of the prior art technique, it is also known that resolution capacity of time-of-flight mass spectrometers is directly proportional to the length of the trajectory of ions in the analyzer (in our case, in the spiral quadrupole optics 270). Therefore, by causing the ions to move along the helical trajectory, it becomes possible to significantly increase the path of ions through the spiral quadrupole optics 270 and to correspondingly increase the resolution capacity of the spiral quadrupole optics 270.

Figure 14:
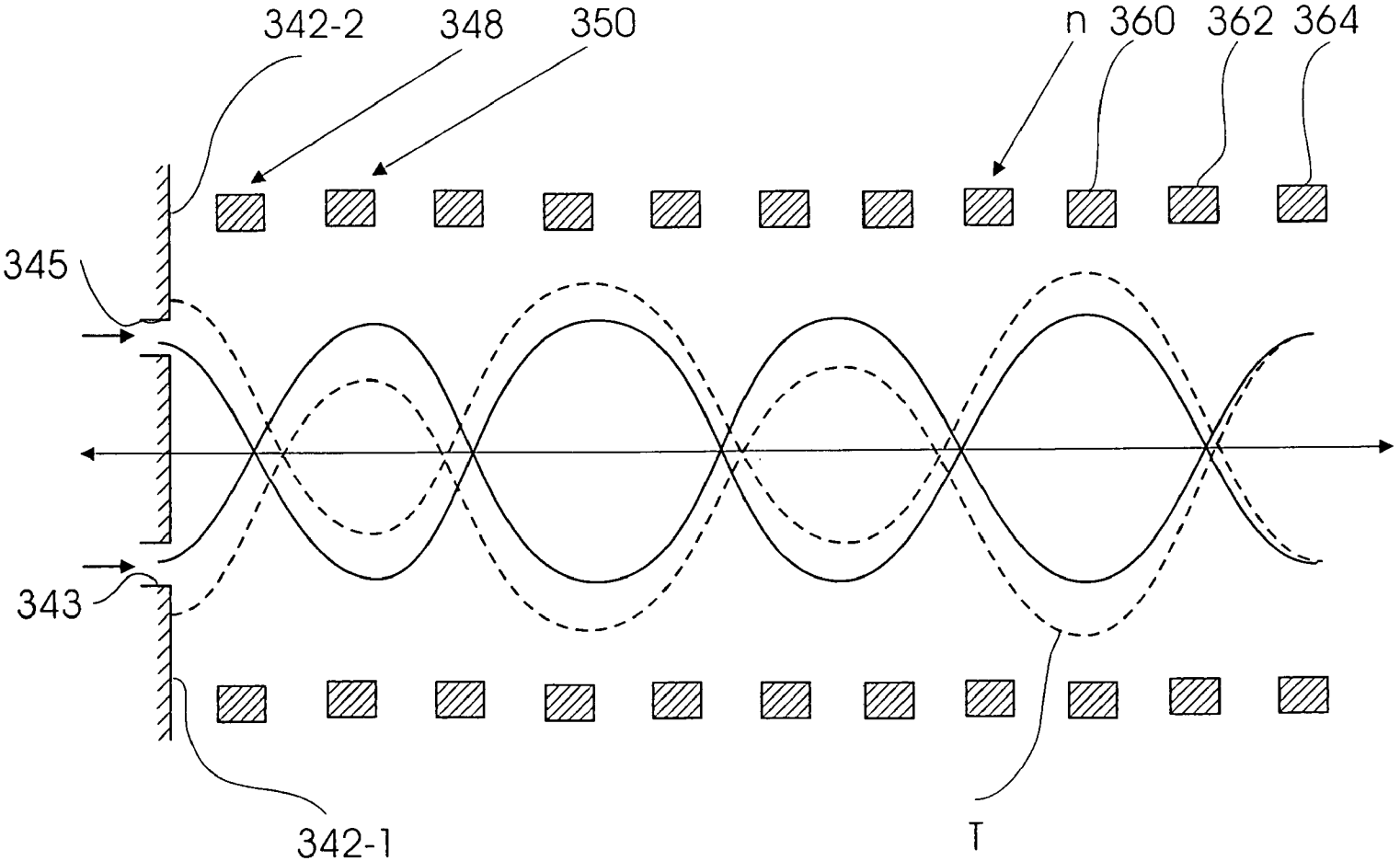
FIG. 14 illustrates two possible trajectories of charged droplets at a specific distribution of the electrostatic potentials on the electrostatic lenses of the spiral quadrupole optics of the invention.

FIG. 14 illustrates two possible trajectories of charged particles at a specific distribution of the electrostatic potentials on the electrostatic lenses of the spiral quadrupole optics 270 of the invention. On its way in the direction of propagation the ion reaches a point $\mathbf{0}_1$ in which its velocity in the Z-axis direction becomes equal to 0 due to the forces pulling the ion back to the ionization device 26 (FIG. 8). In this point of the trajectory the ion reverses its direction and begins to move back towards the ionization device 26. In principle, the point of return can be located at a significant distance from the first lens 348, especially for light ions. Therefore, in order to enhance the retardation force, the spiral quadrupole optics 270 is provided with a reflectron R that consists, e.g., of electrostatic mirrors 360, 362, . . . and 364 (FIGS. 8, 10, 14) coaxial with the quadrupole lenses 348, 350, . . . and arranged after the last lens in the ion propagation direction. Each such mirror comprises a continuous ring with a positive potential applied from a power source 366 (FIG. 9). The mirrors 360, 362, 364 are provided with a potential adjustment means, e.g., by adjusting the voltage on the power source 366. A separate device may be used for improving reflection efficiency.

In contrast to the mass spectrometer disclosed in the aforementioned previous patent application, the spiral quadrupole optics 270 has a simplified construction as it does not use magnetic mirrors, which are present in the previous construction. Such elimination of magnetic fields excludes drift of the particles at the zone of reverse. Therefore, return trajectories of the particles that are reflected only from the electrostatic mirrors 360, 362, and 364 should theoretically coincide with the trajectories in the direction of propagation from the point of injection 340. In reality, however, some factors may affect the charged particles in their return path. The main of these factors is aberrations of the spiral quadrupole optics 270. Thus, the return path will not coincide with the direct path but will be located close to the direct path, and the charged particles that flow in the return direction will collide with detectors 342-1 and 342-2 in the zone around the injecting openings 343 and 345 (FIGS. 7 and 14) within the radial distance of several millimeters, or so, depending on real dimensions of elements of the TOF MS 32.

In other words, the charged particles D injected into the spiral quadrupole optics 270 will flow along their respective individual helical paths with speeds that depend on the mass/charge ratio and will be reflected at different points in the space within the limits of the electrostatic mirrors 360, 362, and 364 (FIGS. 8, 9, 142). Positions of the points of reverse will depend on the initial energy of the charged particles and are regulated by the electrostatic mirror. Thus, on their return paths the particles of the same ion beam current pulse will hit the respective micro-channel plate detectors 342-1 and 342-2 in different points and at different times near the injection opening. It is understood that the charged particles that have been injected into the spiral quadrupole optics 270 through a respective injection opening of the micro-channel plate detector will return to the surface of the same detector.

The charged particles incident on the micro-channel plate detector knock out secondary electrons from the surface of the detector, and the moment of the collision will be registered as a pulse on the output of the respective micro-channel plate detector. In contrast to earlier U.S. patent application Ser. No. 10/058,153, in the system of the present invention the position in which the charged particles collide with the micro-channel plate detectors is of no interest for the analysis, and the only information need for the analysis is the time of collision and the magnitude of the pulse that may contain information about the M/Z ratio for the particles being registered. In other words, the detector plates 342-1 and 342-2 will detect only the integral current, and the intensity of this current and time between the pulses will characterize the M/Z ratio and concentration of the components being sought. Accurate detection of collision time is possible due to extremely high-resolution capacity of these devices. In other words, the spiral quadrupole optics 270 of the present embodiment makes it possible to identify charged particles of different masses that flow along different trajectories simultaneously and in the same space. The above trajectories are initiated from different injectors. In the illustrated embodiment, these injectors are inlet or injection ports 343 and 345 of the TOF MS 32 (FIGS. 8 and 14). Exactly this feature of the TOF MS 32 of the invention makes it possible to realize the device of the invention in the form suitable for operation in a high-duty mode up to 98% of the duty cycle. This is the theoretically maximum possible duty cycle unattainable with any other device or method known in the art.

It should be note that, in contrast to a single flow of charge particles through the mass spectrometer of the aforementioned previous patent application, the aerosol TOF MS 32 may have several simultaneous flows of charged particles. For simplicity of the description and drawings, only two such flows are considered in the present application. So, the aforementioned description of the single flow given above is true with regard to the second flow. In particular, as has been shown in FIG. 7, under the effect of the deflector-modulator 239, the flows F1 and F2 of the particles will be injected in alternating mode to different inlet diaphragms 256 and 258 in the barrier 260 between an MS vacuum chamber 262 and a TOF-MS drift tube 264.

Thus, the TOF MS 32 of the system S of the invention operates in a continuous high-duty mode up to 98% produces an extensive data file. This data is processed and analyzed with the use of a data processing and analyzing system 36 shown in the form of a block diagram in the lower part of FIG. 7. Processes associated with analysis and transmission of the information between the units of the system will be described below after consideration of the data analysis unit 36 and data transmitting/receiving elements.

An important part of the system 36 is a (pseudo-random binary sequences (PRBS) generator 402 that generates a $2^{n-1}$ long code structured as a sequence of digital words or sequences that are finite, digital approximation of "white noise". The techniques for generating pseudo-random codes are well known in communication but a real controller for this device has some difference related to the objects of the present invention to develop a duty cycle close to 100%, where 0 is a non-discarding message for modulation. In result, the pulse duration and space between two adjacent pulses don't have much difference in time. Since the duration of each bunching pulse used for the deflector-modulator 239 (FIGS. 1B and 7) is supposed to exceed the trailing edge's period but simultaneously to be as short as possible and compatible with the hardware of the aerosol TOF MS 32, the minimum pulse spacing is chosen equal to 3 μsec with the pulse duration in the range 1 μsec. Preferably, the pulses in the sequence are randomly modulated in such a manner that no two adjacent selected pulses in the sequence are wider apart than 110% of the narrowest space between them. This is achieved by means of the elements of the data processing and analyzing system 36 described below.

Figure 15:
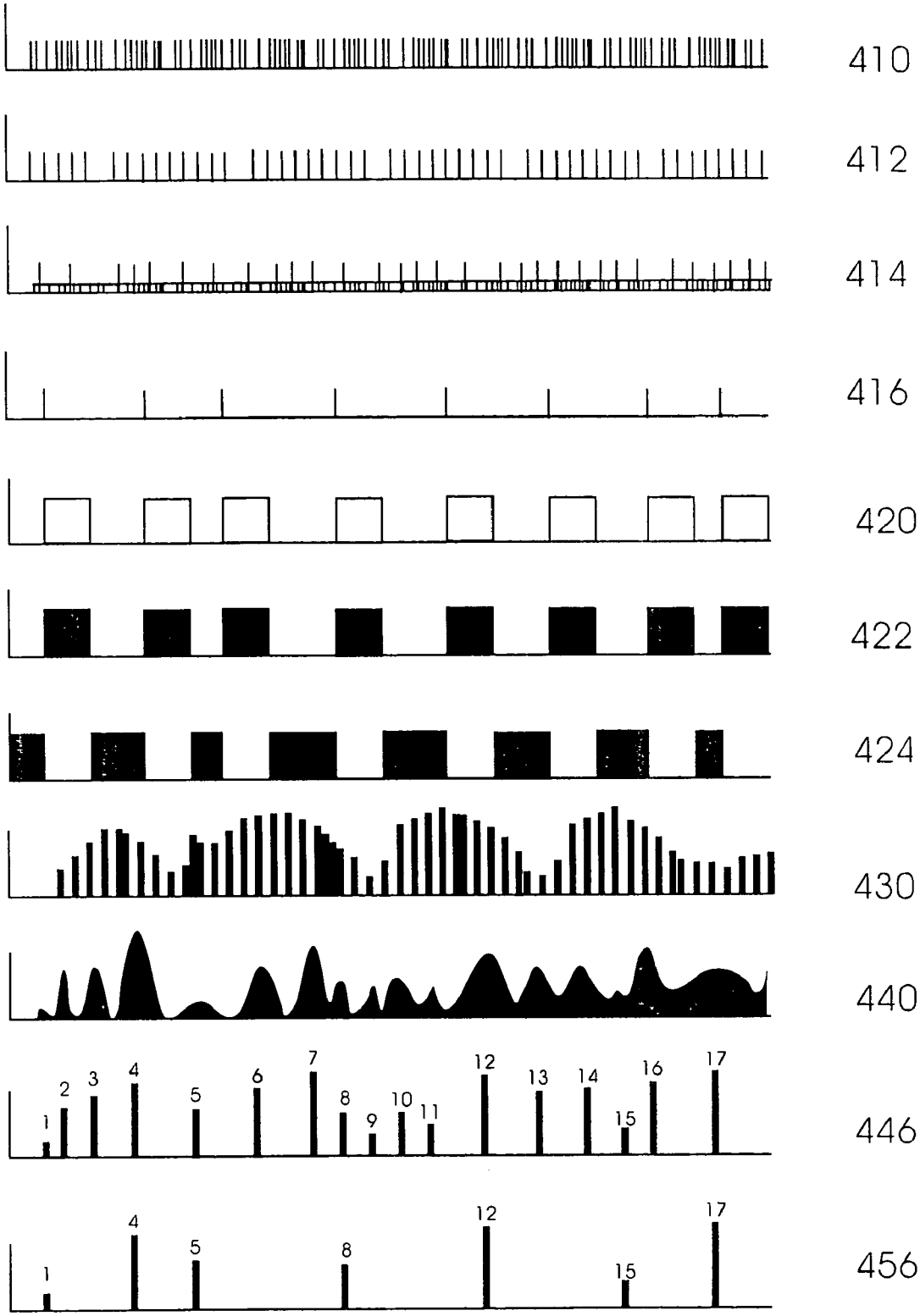
FIG. 15 is a graph illustrating trains of pulses at different stages of mass-spectrometry analysis in the TOF MS of the present invention.

One important group of components in the above system consists of the following sequentially arranged components: a clock generator 404, a trigger or N-times divider 406, the PRBS generator 402, and a dividing system 408. The clock generator 404 generates the clock ticks 410 that are supposed to trigger the PRBS generator 402 (FIG. 1B and FIG. 9) via a trigger 406 by means of a train of pulses 412. The sequence of trains of pulses generated by the components of the system 36 is shown in FIG. 15. If the clock of 100 MHZ is used, the length of a clock tick is 1 second/100 pulses i.e., 10 ns. The length of this pseudo-irregular sequence is supposed to be equal the time of flight of the heaviest ion in the ion packet in the mass spectrometer, for example, 80 μsec. So the clock ticks 410 have to be divided down to approach to this length of sequence. The PRBS generator 402 selects from the divided down clock ticks 412 a pseudo-irregular sequence that controls the deflector-modulator 239 (FIG. 7). If the approximate acquisition period is chosen equal 80 μsec, there are 8,000 clock ticks 410 during this period. Therefore, the clock 404 is connected to the PRBS generator 402 (e.g., of the type Xilinx XC4005XL produced by Xilinx Corporation, San Jose, Calif., USA) to generate the pseudo-irregular sequence of bursts at a rate of 25 MHz through the N-times divider 406 to drive the PRBS generator 402. Herein, N is the factor for dividing down the clock rate to achieve the desired pseudo-noise generator rate. If N is equal 4, the acquisition time around 80 μsec will request the PRBS that is equal to P/N (i.e., 2047) binary events long. The PRBS generator 402 produces on its output a sequence of bursts 414 that consists of 1024 bursts (the number of bursts is always a power of two), and the acquisition time in the acquisition period will be 2047×4×10 ns, i.e., 81.2 μsec. Because the sequence is too fast, only a subset of the bursts of the pseudo-irregular sequence is used to generate the train of the bunching pulses during each acquisition period. So the sequence 414 of the 1024 random bursts is supposed to be grouped in the M groups with Q bursts in each group. Just one from Q bursts in the random temporal position is random selected to trigger a bunching pulse with duration 1 μsec for directing ion packets in two channels of the aerosol TOF MS 32. In this case, Q is selected such that it cannot divide 1024 without leaving a remainder and is determined to be 49. Due to the fact that the divider is 64, the average M is 20.89.

An output of the divider 408 is connected to an input of the aforementioned random-pulse generator 250 (FIG. 7). After being limited by the dividing system 408, the pseudo-random sequence 416 of bursts can trigger the generation of a train 420 of pulses by the aforementioned generator 418 with the random number 20 or 21 bunching pulses with the random deviation of spacing 0.49 μsec inside same acquisition period. So, the train 420 of 20 or 21 bunching pulses with duration 1 μsec and range of spacing 2.5–3 μsec switches through switcher 246 the deflector-modulator 239 (FIG. 7) to direct the ion packets one by one in the different channels. The switcher 246 turns on the power supply 248, if the pulse (P) is present and turns it off, if the pulse is absent (sampling window—SW). In other words, the switcher 246 operates in a mode of a random width-pulse modulation. According to irregular sequence of the pulses, the flow of charged particles changes its path from initial path F1 to the second position F2 with a permanent deflection by the power supply during the sampling window (SW). In both cases, all parts of the stream of particles (F1 and F2) are involved in the analysis by the data acquisition and analysis system 36.

Thus, the SW part is directed in the space of the deflector-modulator 239 that in one of the particle paths directs the flow of charged particles in the aperture of the diaphragm 258. The P part is directed in the space of the deflector-modulator 239 that in the next turn directs the flow in the aperture of the diaphragm 258. This means that the pulse sequence 420 looks like a constant-speed sequence with a certain time jitter on the position of the pulses. This jitter is what now carries the "randomness" of the sequence, as opposed to missing pulses (i.e. large gaps between pulses if one pulse is missed is supposed to be overlapped by a new random distribution). Controlled by this train 420 of bunching pulses with the pseudo-random sequence, the detector-modulator 239 is chopping the continuous stream of particles D. But instead of discarding a part of the particle flow, the detector-modulator 239 just changes the angular positions of the particle flow by alternating it between the diaphragm 256 and 258. Now two discontinuous particle stream F1 and F2 of the ionized packeted particles will pass through the respective diaphragm 256 and 258 with irregular spacing between the packets. The pulses that correspond to the aforementioned flows F1 and F2 with irregular spacing are shown in FIG. 15 as a trains of pulses 422 and 424.

After passing though the flight area, the charged particles D of the two adjacent packets in each F1 and F2 will be reflected by the aforementioned reflectron R and will return back in the direction towards the injectors 343 and 345 approximately along the same trajectory. At the end of their return trajectories, the particles will hit the respective detectors 342-1 or 342-2 that will develop overlapping signals 422 and 424, which are amplified by respective amplifiers 426 and 428 (FIG. 9). The trains of the overlapped amplified signals are shown in FIG. 9 as trains 430 and 432, respectively. Overlapping occurs because the light masses of the second packet of each channel will be represented in the output signal from the detector earlier than heavy masses of first packet, which will come with a certain delay. An example of one of the overlapped signals is designated in FIG. 13 by reference numeral 430.

The system 36 contains a dual channel multiscaller 434, which is connected to the outputs of amplifiers 426 and 428, and from the amplifiers the overlapped signals 430 and 432 are then analyzed by the dual channel multiscaller 434 that detect the spectra of individual packets in each channel. One of the channels of the dual channel multiscaler 434 is connected to a correlator 436, while the other of the channels is connected to a correlator 438. The signals of the dual channel multiscaler are supposed to be correlated with the signal 420 from the random pulse generator 250 (FIGS. 9) in order to inform about the real mass distribution in each channel. The correlation takes place if each channel of the multiscaller 434 is connected simultaneously with the random pulse generator 250 through the correlators 436 and 438. The correlators 436 and 438 provide deconvolution of the detector signals 430 and 432 from the multi-channel plates (detectors) 342-1, 342-2, the amplifiers 426, 428, and the pseudo-random pulse sequence generator 250 modulated by the pseudo-random noise code. The deconvolution establishes a non-overlapping trains 440 and 442, one of which (440) is shown in FIG. 13.

Thus, the aforementioned deconvolution establishes a single demodulated data. The launching sequence and output signal are then shifted in time relative to each other by a predetermined amount to establish a new element-by-element correspondence. Again, the corresponding integer elements are multiplied and the multiplicands are summed to obtain a second demodulated data element. Since the data are processed independently in each channel and since overlapping of the signals in each channel is eliminated, it becomes possible to significantly increase the performance capacity of the aerosol TOF MS 32 with the duty cycle up to 98%. This is because the aerosol TOF MS 32 will not work only during the time required for switching (i.e., the continuity of operation of the spectrometer will be interrupted only for 2% of the operation time).

The pulses from the detectors 342-1, 342-2 do not have a Gaussian shape but typically have short rise-times, much longer fall-times (tails), and varying amplitudes that are supposed to be separated and calculated. The intricate mathematics have to be used to separate adjacent charged-particle lines that have less than one pulse separation. The noise as a result of the low level contamination, i.e., stray charged particles, unstable charged particles exhibiting secondary fragmentation, dark current of the detector, tales of the correlation function, etc., may reduce readability of the meaningful signals. So, two channels are used not only to increase a duty cycle but also to improve the readability of the meaningful signal at the noise level. Therefore, the meaningful signal to useless noise ratio can be much more improved by the second correlation between the demodulated signals from these both channels. Therefore, correlators 436 and 438 from every channel are connected to each other through a second-level correlator 444 responsible for the second deconvolution. As can be seen from FIG. 9, the correlator 444 is located between the first-level correlators 436 and 438. The noise that is not correlated with the signals and with itself is supposed to be suppressed. The influence of the stray charged particles in two channels is also not correlated. The result of this deconvolution is the Gaussian shape of each line amplitude that can be distinguished and calculated more accurately. The output of the second deconvolution is a composition of the mass spectrum 447, which is shown in FIG. 15, while the train of pulses on the output of the second-level correlator 444 is shown in FIG. 9. The histogram 446 (FIG. 15) contains a spectrum of different M/z ratios and other useful information. The width of the Gaussian-shape picks on the oscillogram 440 (FIG. 15) is responsible for mass resolution and can serve simultaneously as "fingerprints" for quick determination of dangerous species by third deconvolution. Even small picks that were shadowed by the noise before the second deconvolution now can be taken in account as fingerprints increasing sensitivity of the device. So, the aerosol TOF MS 32 of the invention generates the aforementioned data histogram 446 (FIG. 15) using the notation [m/z; abundance]. This data histogram provides a fragmentation pattern, for example, as: $[M_1/z; I_1][M_2/z; I_2][M_3/z; I_3][M_4/z; I_4][M_5/z; I_5]$. In other words, the second-level correlator 444 generates signals, and by subsequently analyzing increase or decrease in the amplitude of these signals, it becomes possible to determine if the vehicle V that carries the system S approaches the source of contamination or departs therefrom.

The third deconvolution process is intended for filtering the unnecessary data. This is achieved by identifying the compounds during monitoring of known spectra stored in the memory of the data acquisition system 36 by comparing this data with the data stored in the electronic data bank. For this purposes, the data acquired by the system 36 are first deconvoluted by means of a correlator 436 and 438 at a rate that meets or exceeds the spectrum acquisition rate of the TOF MS 32. This type of deconvolution (i.e. deconvolution of spectral data at least as fast as a mass spectrometer can create a spectral information) is called "on-the-fly" deconvolution. To accommodate deconvolution on-the-fly, it is important that the exemplary deconvolution process be capable of distinguishing relevant and irrelevant deconvolution results. So the data histogram 446 from the second deconvolution correlator 444 provided as the output of the TOF MS 32 is presented against a current deconvolution compound library 452 (FIG. 9) that contains a set of deconvolution compounds 454, and each such compound has its own fingerprint set of M/z ratio and abundance values.

The third deconvolution is simple. The signals from the second deconvolution correlator 444 (see the data histogram 446 in FIG. 15), which in FIG. 7 are shown as a train of pulses 448, are applied to an input of a third-level correlator 450. At the same time, the correlator 450 receives signals from the current deconvolution compound library 452. The third-level correlator 450, e.g., in the form a computer, reads the first compound 454 from the deconvolution library 452 and compares its data file spectral information (its fingerprint) with the current data of the histogram 446. If a spectral match occurs, indicating that the library compound spectra are presented in the histogram, then the system 400 removes portions of the input data spectrum histogram by calculating an appropriate coefficient associated with the given compound. At least one entire histogram peak that is associated with a matched compound 456 (FIGS. 7 and 15) is subtracted. After all the deconvolution compounds 456 in the compound library 452 have been sequentially tested against the histogram data 446 and step-by-step removal of compound fingerprints and compound remainder is close to zero, the third correlator 450 sends signal "Yes " to an antenna 458 (FIGS. 1A and 7) that is intended for communication, e.g., with a navigation unit 460. This means that a spectral match occurs.

If the third correlator 450 sends signal "No", the correlator-controlled valve 21 (FIG. 1B) is switched in search mode and the aerodynamic lens (15) provides scanning of different sizes of particles of the supersonic flow. Simultaneously, the controller (not showed) of the control electrode (32) each electron gun (26) is scanning the length of the ionization area of the ionizer (24) to find the optimal residence time to prevent incoming spores or compound from partition. The ion beam with the limited number of the ionized particles is bunched by the modulator-deflector (32) and two ion beams are injected in the TOFMS. After deconvolution using just one channel of the data acquisition system we can receive a histogram (93) of M/z ratio. (FIG. 8). The fast third deconvolution in fly and NIST library(94) in computer helps to identify species up to signal "Yes" After computer switches the valve (21) and controller of ionizer in the fixed mode. The aerodynamic lens focuses just a fixed size of the compound or spore and the ionizer provides the fixed residential time to ionize (not destroy) the compound. Now we can use two histograms and using the second deconvolution to remove noise and receive a proper histogram (95) with a precise abundance. This abundance can be calculated and compared with the abundance of the next incoming histogram. The positive increment of the abundance tells to the navigation system that the platform approaches to the source of contamination.

Many units and devices of the system S of the invention are interconnected via various links and feedback lines. This is because modes of operations of certain units depends on the states and conditions of other units. In order to understand the principle of operation of the system S, it is important first to consider the aforementioned links and feedbacks during the operation of the system.

Figure 16:
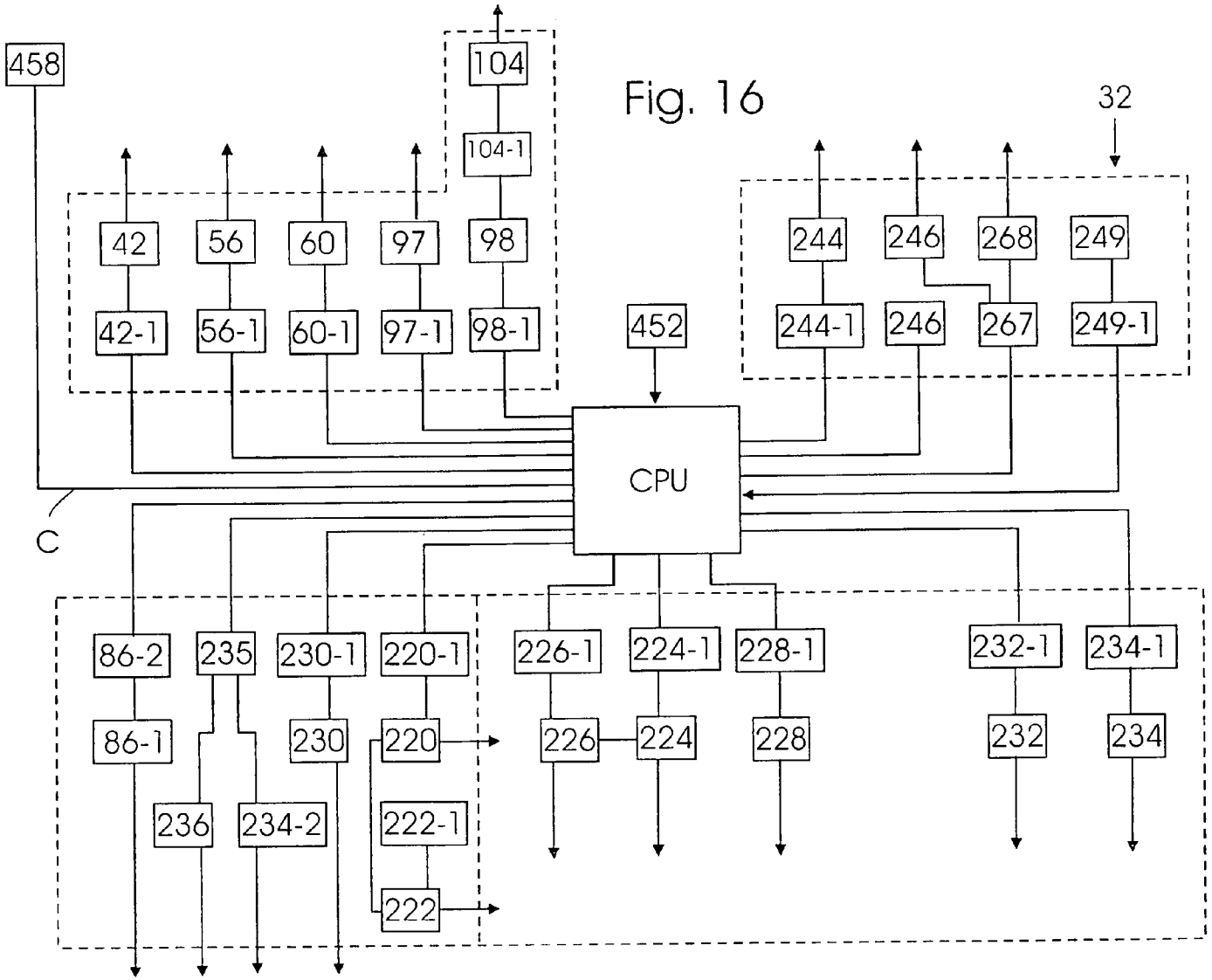
FIG. 16 is a block diagram that illustrates links between the units of the system of the invention.

FIG. 16 is a block diagram that illustrate main links and feedbacks between the units and device of the invention that have been described above with reference to FIGS. 1–15. In addition to various motors, pumps, and other actuating members that have been shown in FIGS. 1–15, the block diagram of FIG. 16 also shows their respective drivers and controllers.

As has been mentioned above, the main component of the data acquisition and analysis unit 36 is CPU (FIG. 16). It is important to mention that the third-level correlator 450, which is shown in FIG. 7 as an output component of the data acquisition and analysis unit 36, is included into the CPU of FIG. 16. The antenna 458 (FIGS. 1A and 7) of the navigation unit 460 is also connected to the CPU via the communication cable C.

The components of the sample preparation unit 22 which are connected to the CPU through respective drivers are the following (FIGS. 2 and 16): the signal source 42 with respective driver 42; the gas source 56 with respective pump with a driver 56-1; the heater rods 60 with a power supply and a controller 60-1; the preliminary vacuum pump 97 with a controller 97-1; the CPU-controlled valve 98 of the vacuum pump 100 with a controller 98-1; and the vacuum pump 104 with a controller 104-1.

The components of the ionization unit 26 which are connected to the CPU through respective controllers are the following (FIGS. 2 and 16): a step motor 86-1 of the rotary diaphragm-replacement system 86 with a driver/controller 86-1; a controller 235 that controls operation of the power supply units 236 and 234-2; a controller 230-1 for controlling operation of the power supply unit 230; controllers 220-1 and 2-1 for controlling operation of the power supply units 220 and 222. A group of controllers 226-1, 224-1, 228-1, and 232-1 control operation of power sources 226, 224, 228, 232 respectively. The purposes of changing potentials on the outputs of the aforementioned power source have been described earlier in the consideration of the ionization unit 26 with reference to FIG. 3B. The above potential changes and controls are required for optimization of operation of various units in relation to the characteristics of the particles that entered the sampling unit 22. Another important component of the group belonging to the ionization unit 26 is a controller 234-1 of the power supply source 234 which is connected to the negative terminal of the DC power supply 234 that is responsible for acceleration of the particles ionized in the ionization unit 26.

The group of control components which are connected to the CPU and are associated with the operation of the TOF MS 32 and the steering deflector 238 (FIG. 7) consists of the following: the DC power supply 244 with a driver 244-1; the switcher 246 that provides the deflection of the ion beam with angle $\alpha$; adjustable DC power supplies 266 and 268 for the supply of voltage to the electrodes of the steering deflector 238; and the common power supply unit 249 with a controller 249-1 that control operation of the TOF MS 32.

The CPU is also connected to the data or current deconvolution compound library 452.

The mass spectrometry system S of the invention for continuous control of environment can operate in an autonomous mode when the data obtained and analyzed inboard, i.e., without connection with the ground station (not shown), or in a remote-control mode with wireless links to the ground station. In the context of the present patent application, the term "ground station" coves facilities not only on the ground but also on the surface of water, e.g, on a boat, or on a board of an aircraft.

Figure 17:
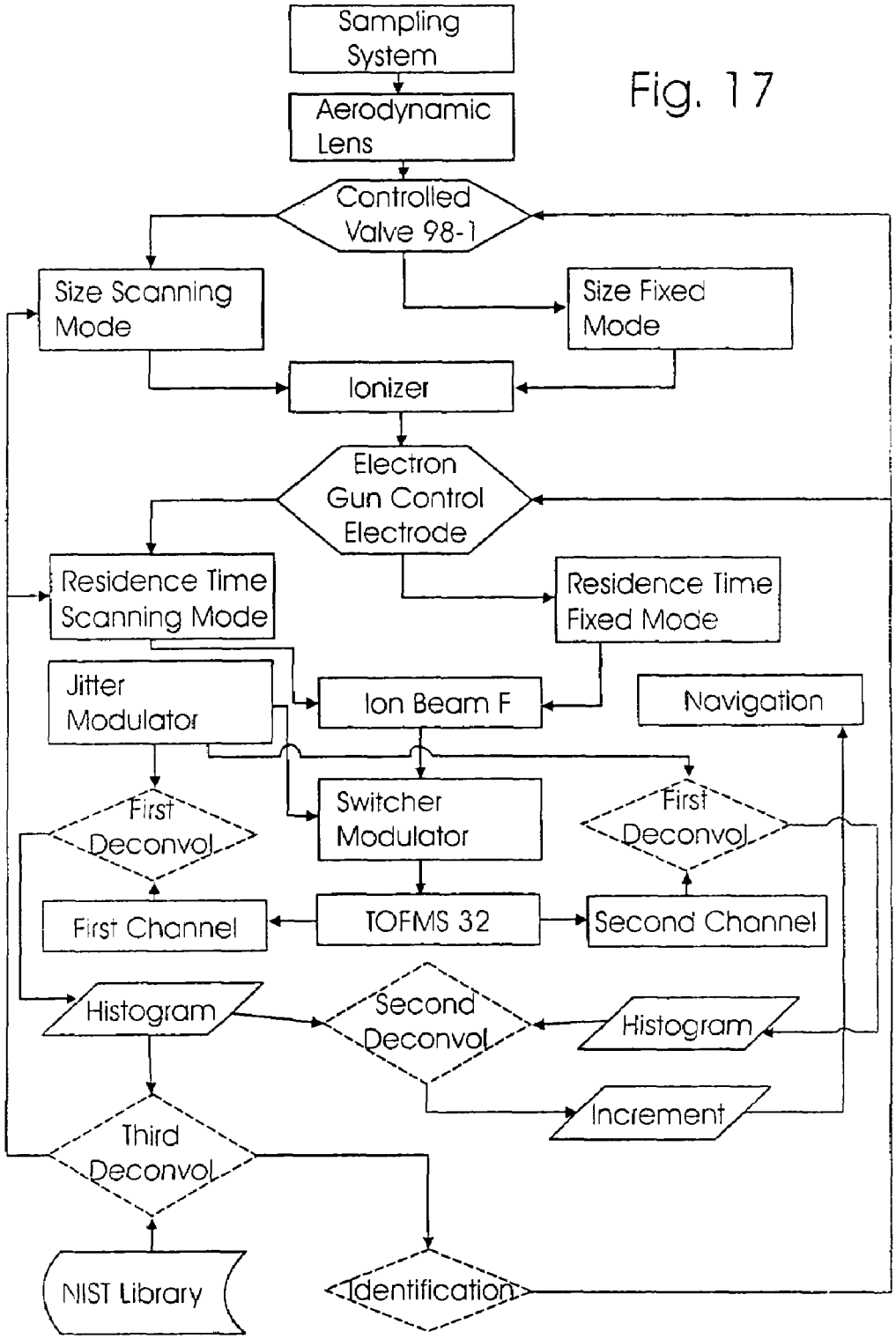
FIG. 17 is a flow chart that illustrates operation of the system of the invention as a strategy of searching a source of contamination.

FIG. 17 is a flow chart that illustrates operation of the system S as a strategy of searching a source of contamination, e.g., in water. It is understood that the description given below with reference to FIG. 17 relates only to one possible mode of interaction between the units of the system S via the CPU.

When in the aforementioned mode the CPU (FIG. 16) sends signal "No" to the computer-controlled valve 98 (FIG. 2, 17, and 17), the is switched to a search mode, and the aerodynamic lens stage 62 provides scanning of particles of different sizes in the supersonic flow F of droplet D. Simultaneously, a signal is sent via the controller 232-1 to a power source 232 that is connected to the bodies of four electron guns 210, 212, 214, and 216 (FIG. 5), which are also known as Wehnelt electrodes, so that each electron gun begins to scan the length of the ionization area (FIG. 5) of the ionizer 26 to find the optimal residence time for preventing the incoming particles from disintegration.

The ion beam with a limited number of the ionized droplets D is then passed through the deflector modulator 239 with a steering deflector 238 (FIG. 1B) which provides alternating deflections of the flow of particles between two positions F1 and F2 for aligning the flow with two inlet openings 256 and 258 into the TOF MS 32. After the first deconvolution via the first-level correlators 436 and 438 using just one channel of the data acquisition system 36 (FIG. 7), a histogram of M/z ratio shown in FIG. 15 is obtained. The second deconvolution can be performed with the use of the second correlator 444, while the fast third deconvolution can be carried out either via and data library 452 (FIGS. 7 and 16) help to identify species of the droplets. When droplets of the sought substance are detected, the CPU activates the valve 98 of the ionization device 26 via the controller 98-1 of the valve (FIG. 16) and switches the ionization device 26 to a fixed mode of operation. In other words, the ionization device 26 continue to operation with a constant zone of ionization.

The aerodynamic lens stages 62 and 64 (FIG. 2) focus the beam to a fixed size of droplets D, and the ionization device 26 provides a fixed residential time (i.e., the length of the zone of ionization (FIG. 5). The droplets D are ionized without deterioration. In this mode, an important role belongs to the second deconvolution that is carried out by means of the correlator 444. Third deconvolution is performed by means of the correlator 450 that may work ether independently or included into the CPU. In the third deconvolution, the obtained data are compared with those contained in the data library 452. This particular mode of operation with switching from the search mode to the library mode is shown in the flowchart of FIG. 17.

The final histograms, e.g., two histograms, are obtained with a precise abundance. This abundance can be calculated and compared with the abundance of the next incoming histogram. The positive increment of the abundance tells to the navigation unit 460 that the vehicle V approaches the source of contamination.

Thus, it has been shown that the invention provides a system for continuous real-time control of environment on the a basis of an aerosol time-of-flight mass (TOF MS) spectrometer suitable for continuous operation in a high-duty mode. The aforementioned system has a compact construction, can be installed on a vehicle moveable through the controlled environment, is provided with self-adjustment means that can tune the sample preparation unit and the mass spectrometer to the most optimal conditions of operation, depending on the type of detected particles, is universal and can operate in a mode of interaction with the on-board data library or in a mode of interaction with a remotely located control station.

Although the invention has been shown and described with reference to specific embodiments, it is understood that these embodiments should not be construed as limiting the areas of application of the invention and that any changes and modifications are possible, provided these changes and modifications do not depart from the scope of the attached patent claims. For example, the vehicle may comprise an automobile, aircraft, submarine, or manually moveable platform that can be installed in any specific place, e.g., in a stationary water control station with running water, or in water basins of different depths. The system of the invention can be used, e.g., for air-pollution control purposes. The flow of the ionized droplets can be divided by the deflector-modulator into more than two separate flows that can fly through the drift tube of the TOF MS simultaneously and analyzed irrespective from each other. For this purpose, the TOF MS will have more than two inlet ports and more than two respective detectors. The number of quadrupole electrostatic lenses may be different from nine. The quadrupole lenses in the series can be angularly shifted not necessarily to equal angles. For example, in each subsequent lens the shift angle may be increased. Lenses with angular shift can alternate with lenses without angular shift. The diameter of quadrupole lenses may decrease or increase in the direction of propagation and can be inscribed into a conical surface. The lenses can be axially spaced at difference distances. The mass spectrometer can be used without circular electrostatic mirrors. The particles will move along any given spatial trajectory, not necessarily helical. The system may be mounted on a ground vehicle with an antenna installed on the same vehicle.

The invention claimed is:

1. A mass spectrometry system for continuous control of environment by detecting a source of contamination comprising:

system carrying means;

a sampling unit installed in said system carrying means having sample extraction means for extracting samples from said environment, said sampling unit having an output;

an ionization device connected to said output of said sampling unit and supported by said system carrying means, said ionization device forming a beam of ionized particles from said samples, said ionization device having an ionization device input and an ionization device output;

a time-of-flight mass spectrometer, which is supported by said system carrying means and has a mass spectrometer input, mass spectrometer output, and a deflector modulator connected to said ionization device output for alternatingly deflecting said beam of ionized particles with a predetermined angle for dividing said beam of ionized particles into two independent flows guided along two independent trajectories; and a data acquisition and analysis unit that acquires data from said sampling unit, said ionization device, and said time-of-flight mass spectrometer, said data acquisition and analysis unit having means for analysis of said data and for generating control data that controls and monitors operations of said sampling unit, said ionization device, and said time-of-flight mass spectrometer.

2. The mass spectrometry system of claim 1, wherein said time-of-flight mass spectrometer comprises:

electrostatic field generation means for generating an electrostatic field for causing said ionized particles in each of said two independent trajectories to fly in a direct path from said mass spectrometer input to a side opposite to said mass spectrometer input and in a return path from said side opposite to mass spectrometer input towards said mass spectrometer input; and a charged particle detector means for detecting positions of collisions of said charged particles with said charged particle detector means for determining the time of flight of said charged particles independently for each of said at least two flows, said charged particle detector means being located in the vicinity of said mass spectrometer input.

3. The mass spectrometry system of claim 2, wherein said electrostatic field generation means comprise:

a plurality of quadrupole electrostatic lenses which are arranged in series and coaxially in said direction of said beams of ionized particles, each of said quadrupole electrostatic lenses comprising a circular body formed by four arch-shaped poles located substantially in a common plane perpendicular to said central longitudinal axis and arranged circumferentially about said central longitudinal axis in the form of a first pair composed of two diametrically opposite and electrically connected poles and a second pair composed of two diametrically opposite and electrically connected poles, in each of said quadrupole electrostatic lenses said poles being angularly shifted with respect to said poles of a quadrupole electrostatic lens subsequent in said direct path by a selected angle in order to provide said angular gradient of the electrostatic field between adjacent quadrupole lenses of said plurality and thus to cause said charged particles to move along said curvilinear trajectories; and mirror means comprising: an electrostatic mirror located on said opposite side for reflecting said charged particles and for directing said charge particles to said return path.

4. The mass spectrometry system of claim 3, wherein said deflector modulator comprises: a first electrode plate and a second electrode plate spaced from said first electrode plate, said first electrode plate being connected to a first power supply that provides deflection of said single flow of charged particles by an angle $\alpha$ towards one of said at least two inlet ports, said second electrode plate being connected to a second power supply via a switching unit that provides deflection of said single flow of charged particles by an angle $2\alpha$ towards another of said at least two inlet ports; a steering unit for correcting said two independent flows on their way from said ionization device towards said input of said mass spectrometer; and random pulse modulation means connected to said charged-particle deflection means for generating irregular sequence of said charged particles in said at least two flows.

5. The aerosol time-of-flight mass spectrometer system according to claim 4, wherein said inlet of said mass spectrometer comprises at least a first inlet port and a second inlet port, said steering unit comprising a third electrode plate connected to a source of a permanent potential, a fourth electrode plate connected to a source of a permanent potential, and a fifth grounded electrode located between said third electrode and said fourth electrode, one of said at least two flows of charged particles being directed to said first inlet port via a space between said third plate electrode and said fifth grounded electrode, while another of said at least two flows of charged particles being directed to said second inlet port via a space between said fourth plate electrode and said fifth grounded electrode.

6. The aerosol time-of-flight mass spectrometer system according to claim 3, wherein said selected angle is equal to 360° divided by the number of quadrupole electrostatic lenses in said plurality.

7. The aerosol time-of-flight mass spectrometer system according to claim 6, wherein said curvilinear trajectories are helical trajectories.

8. The aerosol time-of-flight mass spectrometer system according to claim 5, wherein said selected angle is equal to 360° divided by the number of quadrupole electrostatic lenses in said plurality.

9. The aerosol time-of-flight mass spectrometer system according to claim 8, wherein said curvilinear trajectories are helical trajectories.

10. The aerosol time-of-flight mass spectrometer system according to claim 4, wherein said means for analysis of said data and for generating control data of said data acquisition and analysis unit comprises a central processing unit, first-level correlators with means for performing a first deconvolution that establishes a non-overlapping trains of data obtained from said charged particle detector means, a second-level correlator with means for performing a second deconvolution and for generating a signal that has an amplitude for determining, by analyzing increase or decrease of said amplitude, whether said aerosol time-of-flight mass spectrometer system approaches or departs from said source of contamination; and a third level correlator for performing a third deconvolution for filtering out a noise from said signal and for identifying species of said particles, said first level correlators, said second-level correlator, and said third-level being connected to said central processing unit; said first-level correlators being connected to said random pulse modulation means.

11. The aerosol time-of-flight mass spectrometer system according to claim 10, wherein data acquisition and analysis unit further comprises data storage means, said charged particle detector means comprising a first detector for detecting positions of collision of particles in said return path of one of said at least two flows and a second detector for detecting positions of collision of particles in said return path of another one of said at least two flows; said first-level correlators comprising two correlators of first level of correlation, one of which is connected to said first detector and another one to said second detector; said two correlators of first level of correlation being interconnected through said second-level correlator; and said third-level correlator being connected to said second level correlator and to said data storage means.

12. The aerosol time-of-flight mass spectrometer system according to claim 9, wherein said means for analysis of said data and for generating control data of said a data acquisition and analysis unit comprises a central processing unit, first-level correlators with means for performing a first deconvolution that establishes a non-overlapping trains of data obtained from said charged particle detector means, a second-correlator with means for performing a second deconvolution and for generating signal that has an amplitude for determining, by analyzing increase or decrease of said amplitude, whether said aerosol time-of-flight mass spectrometer system approaches or departs from said source of contamination; and a third level correlator for performing a third deconvolution for filtering out a noise from said signal and for identifying species of said particles, said first level correlators, said second-level correlator, and said third-level being connected to said central processing unit; said first-level correlators being connected to said random pulse modulation means.

13. The aerosol time-of-flight mass spectrometer system according to claim 12, wherein data acquisition and analysis unit further comprises data storage means, said charged particle detector means comprising a first detector for detecting positions of collision of particles in said return path of one of said at least two flows and a second detector for detecting positions of collision of particles in said return path of another one of said at least two flows; said first-level correlators comprising two correlators of first level of correlation one of which is connected to said first detector and another one to said second detector; said two correlators of first level of correlation being interconnected through said second-level correlator; and said third-level correlator being connected to said second level correlator and to said data storage means.

14. The aerosol time-of-flight mass spectrometer system according to claim 1, wherein said system carrying means comprises a vehicle moveable in said environment.

15. The aerosol time-of-flight mass spectrometer system according to claim 14, wherein said vehicle is selected from a group consisting of an underwater vehicle, a ground vehicle, and an aircraft.

16. The aerosol time-of-flight mass spectrometer system according to claim 15, wherein said environment is water, and said vehicle is an underwater vehicle, said underwater vehicle, said system further comprising a remote navigation station and antenna means located outside said water, said antenna being electrically connected to said data acquisition and analysis data and connected to said remotely located navigation system via connection means selected from the group of electrical connection means and wireless connection means, said data storage means being located in a place selected from the group consisting of said underwater vehicle and said remotely located navigation system.

17. The mass spectrometry system of claim 16, wherein said time-of-flight mass spectrometer comprises:

electrostatic field generation means for generating an electrostatic field for causing said beams of ionized particles in each of said two independent trajectories to fly in a direct path from said mass spectrometer input to a side opposite to a side opposite to said mass spectrometer input and in a return path from said side opposite to mass spectrometer input towards said mass spectrometer input; and a charged particle detector means for detecting positions of collisions of said charged particles with said charged particle detector means for determining the time of flight of said charged particles independently for each of said at least two flows, said charged particle detector means being located in the vicinity of said mass spectrometer input.

18. The mass spectrometry system of claim 17, wherein said electrostatic field generation means comprise:

a plurality of quadrupole electrostatic lenses which are arranged in series and coaxially in said direction of said beams of ionized particles, each of said quadrupole electrostatic lenses comprising a circular body formed by four arch-shaped poles located substantially in a common plane perpendicular to said central longitudinal axis and arranged circumferentially about said central longitudinal axis in the form of a first pair composed of two diametrically opposite and electrically connected poles and a second pair composed of two diametrically opposite and electrically connected poles, in each of said quadrupole electrostatic lenses said poles being angularly shifted with respect to said poles of a quadrupole electrostatic lens subsequent in said direct path by a selected angle in order to provide said angular gradient of the electrostatic field between adjacent quadrupole lenses of said plurality and thus to cause said charged particles to move along said curvilinear trajectories; and mirror means comprising: an electrostatic mirror located on said opposite side for reflecting said charged particles and for directing said charge particles to said return path.

19. The mass spectrometry system of claim 18, wherein said deflector modulator comprises: a first electrode plate and a second electrode plate spaced from said first electrode plate, said first electrode plate being connected to a first power supply that provides deflection of said single flow of charged particles by an angle $\alpha$ towards one of said at least two inlet ports, said second electrode plate being connected to a second power supply via a switching unit that provides deflection of said single flow of charged particles by an angle $2\alpha$ towards another of said at least two inlet ports; a steering unit for correcting said two independent flows on their way from said ionization device towards said input of said mass spectrometer; and random pulse modulation means connected to said charged-particle deflection means for generating irregular sequence of said charged particles in said at least two flows.

20. The aerosol time-of-flight mass spectrometer system according to claim 19 wherein said inlet of said mass spectrometer comprises at least a first inlet port and a second inlet port, said steering unit comprising a third electrode plate connected to a source of a permanent potential, a fourth electrode plate connected to a source of a permanent potential, and a fifth grounded electrode located between said third electrode and said fourth electrode, one of said at least two flows of charged particles being directed to said first inlet port via a space between said third plate electrode and said fifth grounded electrode, while another of said at least two flows of charged particles being directed to said second inlet port via a space between said fourth plate electrode and said fifth grounded electrode.

21. The aerosol time-of-flight mass spectrometer system according to claim 18, wherein said selected angle is equal to 360° divided by the number of quadrupole electrostatic lenses in said plurality.

22. The aerosol time-of-flight mass spectrometer system according to claim 21, wherein said curvilinear trajectories are helical trajectories.

23. The aerosol time-of-flight mass spectrometer system according to claim 20, wherein said selected angle is equal to 360° divided by the number of quadrupole electrostatic lenses in said plurality.

24. The aerosol time-of-flight mass spectrometer system according to claim 23, wherein said curvilinear trajectories are helical trajectories.

25. The aerosol time-of-flight mass spectrometer system according to claim 17, wherein said means for analysis of said data and for generating control data of said a data acquisition and analysis unit comprises a central processing unit, first-level correlators with means for performing a first deconvolution that establishes a non-overlapping trains of data obtained from said charged particle detector means, a second-correlator with means for performing a second deconvolution and for generating signal that has an amplitude for determining, by analyzing increase or decrease of said amplitude, whether said aerosol time-of-flight mass spectrometer system approaches or departs from said source of contamination; and a third-level correlator for performing a third deconvolution for filtering out a noise from said signal and for identifying species of said particles, said first level correlators, said second-level correlator, and said third-level correlator being connected to said central processing unit, said third level correlator being located in a place selected from the group consisting of said CPU and a place beyond said CPU; said first-level correlators being connected to said random pulse modulation means.

26. The aerosol time-of-flight mass spectrometer system according to claim 25, wherein data acquisition and analysis unit further comprises data storage means, said charged particle detector means comprising a first detector for detecting positions of collision of particles in said return path of one of said at least two flows and a second detector for detecting positions of collision of particles in said return path of another one of said at least two flows; said first-level correlators comprising two correlators of first level of correlation one of which is connected to said first detector and another one to said second detector; said two correlators of first level of correlation being interconnected through said second-level correlator; and said third-level correlator being connected to said second level correlator and to said data storage means.

27. The aerosol time-of-flight mass spectrometer system according to claim 26, wherein said means for analysis of said data and for generating control data of said a data acquisition and analysis unit comprises a central processing unit, first-level correlators with means for performing a first deconvolution that establishes a non-overlapping trains of data obtained from said charged particle detector means, a second-correlator with means for performing a second deconvolution and for generating signal that has an amplitude for determining, by analyzing increase or decrease of said amplitude, whether said aerosol time-of-flight mass spectrometer system approaches or departs from said source of contamination; and a third level correlator for performing a third deconvolution for filtering out a noise from said signal and for identifying species of said particles, said first level correlators, said second-level correlator, and said third-level being connected to said central processing unit; said first-level correlators being connected to said random pulse modulation means.

28. The aerosol time-of-flight mass spectrometer system according to claim 27, wherein data acquisition and analysis unit further comprises data storage means, said charged particle detector means comprising a first detector for detecting positions of collision of particles in said return path of one of said at least two flows and a second detector for detecting positions of collision of particles in said return path of another one of said at least two flows; said first-level correlators comprising two correlators of first level of correlation one of which is connected to said first detector and another one to said second detector; said two correlators of first level of correlation being interconnected through said second-level correlator; and said third-level correlator being connected to said second level correlator and to said data storage means.

29. The aerosol time-of-flight mass spectrometer system according to claim 28, wherein said ionization device further comprising ionization optimization means connected to said central processing unit and to said particle sampling means, and particle acceleration means connected to said central processing unit and to said ionization device.

* * * * *